US008175485B2

(12) United States Patent
Ono

(10) Patent No.: US 8,175,485 B2
(45) Date of Patent: May 8, 2012

(54) IMAGE HEATING APPARATUS

(75) Inventor: Kazuaki Ono, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 548 days.

(21) Appl. No.: 12/391,994

(22) Filed: Feb. 24, 2009

(65) Prior Publication Data

US 2009/0297201 A1 Dec. 3, 2009

(30) Foreign Application Priority Data

May 28, 2008 (JP) ..... 2008-139679

(51) Int. Cl.
*G03G 15/00* (2006.01)
*G03G 15/20* (2006.01)

(52) U.S. Cl. ..... 399/88; 399/69; 399/328

(58) Field of Classification Search ..... 399/67, 399/69, 70, 88, 328, 330, 334
See application file for complete search history.

(56) References Cited

U.S. PATENT DOCUMENTS 5,682,576 A 10/1997 Sakai et al.

FOREIGN PATENT DOCUMENTS

| | | |
|---|---|---|
| JP | 08-185080 | 7/1996 |
| JP | 11-84934 | 3/1999 |
| JP | 2002-251096 | 9/2002 |
| JP | 2004-37555 | 2/2004 |

*Primary Examiner* — Hoang Ngo
(74) *Attorney, Agent, or Firm* — Canon USA Inc IP Division

(57) ABSTRACT

An image heating apparatus includes an image heating rotational member configured to heat an image on a recording material, a pressure member configured to form a nip portion with the image heating rotational member and pinch the heated recording material in the nip portion, a first external heater including a first heat generation member and configured to contact an outer surface of the image heating rotational member and heat an area of the image heating rotational member that has passed the nip portion, and a second external heater including a second heat generation member and configured to contact an outer surface of the image heating rotational member and heat an area of the image heating rotational member heated by the first external heater. In the image heating apparatus, maximum power applied to the second heat generation member is smaller than maximum power applied to the first heat generation member.

5 Claims, 19 Drawing Sheets

IMAGE HEATING APPARATUS

BACKGROUND OF THE INVENTION

1. Field of the Invention

The present invention relates to a heating apparatus including a plurality of external heaters configured to heat an image heating rotational member that heats an image on a recording material.

2. Description of the Related Art

In recent years, it is desired by the market that an image forming apparatus, such as a copying machine, a printer, or an multifunction peripheral (MFP), has a high processing speed, is capable of printing a high quality image and executing color printing, and can save energy. It is also desired that an image forming apparatus is capable of executing printing on various type of recording media, such as thick paper, rough paper, rugged paper, and coated paper, and has a high productivity (i.e., is capable of printing a large number of print sheets in a unit time).

Under such circumstances, in an electrophotographic image forming apparatus, it is necessary to increase the heating property of a heating apparatus in order to increase the productivity particularly when a recording material having a large grammage is used.

However, the amount of heat necessary to fix a recording material having a large grammage (thick paper) is far larger than that necessary to fix a recording material having a small grammage (thin paper). Therefore, a large amount of heat is lost from a fixing roller (image heating rotational member) at the time of fixing. Accordingly, the surface temperature of the fixing roller may decrease and fixing failure may occur. Accordingly, in a case of fixing thick paper, in order to secure the fixing property (the bonding strength between a toner and a recording material), a conventional method executes fixing processing by feeding a recording material into a heating apparatus at a relatively low speed.

If a fixing roller is used that includes a pipe-shaped metal core on which a heatproof elastic layer made of a material such as silicon rubber or fluorine rubber is formed, the above-described decrease of the surface temperature of a fixing roller may occur partly due to the low thermoconductivity of the metal core and the elastic layer. More specifically, in this case, the heat of a heat generation member (a halogen heater, for example), which is provided in the core of the fixing roller, is shielded by the core and the elastic layer. Thus, the heat of the heat generation member is not appropriately applied on the surface of the fixing roller.

In this regard, a conventional method employs a fixing roller including no such elastic layer. In this case, the decrease of the surface temperature of the fixing roller becomes small because no elastic layer is used. However, because of a thick core used in this case, the surface temperature of the fixing roller may decrease, which may shield the heat as described above.

Furthermore, if a core including no elastic layer is used, in recording on a recording material having a considerable rug on its surface, a toner applied on a concave portion of the surface of the recording material and the fixing roller may not appropriately contact each other. Thus, the toner on the concave portion may not be normally fixed.

Furthermore, in developing a color image, the surface of the image cannot be evenly fused. Accordingly, in this case, phenomena of unevenly fixed toner, uneven gloss, and uneven color may occur. Therefore, the image quality may degrade.

Accordingly, it is useful to provide a fixing roller with such an elastic layer in order to enable recording on various types of recording materials and increase the image quality. On the other hand, if a fixing roller is rapidly heated with a heat generation member having a high normal rated power in order to prevent the decrease of the surface temperature of the fixing roller, the temperature of the core may rapidly rise. In this case, a bonding layer between the core and the elastic layer may be damaged or broken due to thermal degradation. As a result, the elastic layer may break away from the core or the elastic layer may be damaged or broken due to softening deterioration or hardening deterioration caused by the heat.

Consequently, Japanese Patent Application Laid-Open No. 2002-251096 discusses a method for executing fixing without reducing the speed of feeding a recording material through a heating apparatus. In this method, a fixing roller is heated from its external surface by an external heating roller that contacts the outer surface of the fixing roller. The conventional method can prevent the decrease in the surface temperature of a fixing roller while preventing the rise in the temperature of the core.

Furthermore, it is useful to set the temperature of an external heating roller at a high value in order to increase the heating property of the external heating roller. However, the temperature of the external heating roller cannot be set at a very high value considering the limit of heat resistance of the external heating roller. On the other hand, if a wide contact area between an external heating roller and a fixing roller is secured, the temperature can be set low. However, in this case, the size of the external heating member itself may become large and thus the size of the heating apparatus may become large. Accordingly, Japanese Patent Application Laid-Open No. 2004-37555 discusses a relatively small size heating apparatus including a plurality of external heating members and capable of increasing the heating property of an external heating roller.

Meanwhile, as a method for adjusting the temperature of a heating roller, a conventional method discussed in Japanese Patent Application Laid-Open No. 08-185080 powers on and off a heat generation member provided in a heating roller.

However, when a plurality of external heating rollers is used, the amount of heat transferred from a downstream external heating roller to a fixing roller may decrease. As a result, when the temperature adjustment is executed by powering on and off a heat generation member as discussed in Japanese Patent Application Laid-Open No. 08-185080, the length of time of supplying power to the heat generation member provided in a downstream external heating member is short. Accordingly, the surface temperature of the fixing roller may become uneven. The problem like this will be described in detail below.

Considering the capacity of an external heating roller that heat a fixing roller when a plurality of external heating members is provided, it is useful to set a target temperature in adjusting the temperature of each external heating roller at a high value. In this case, the target temperatures in adjusting the temperature of a plurality of external heating rollers become substantially the same.

Meanwhile, when the heat is transferred from a fixing roller to a recording material, the temperature of an area of the fixing roller heated by an upstream external heating roller may decrease. Thus, the difference between the temperature of the upstream external heating member and that of the fixing roller becomes large. Therefore, a large amount of heat is transferred from the upstream external heating roller to the fixing roller and the time of supplying power to the heat generation member of the upstream external heating roller may become longer.

On the other hand, the area of the fixing roller heated by the downstream external heating roller is heated by the upstream external heating roller. Accordingly, the difference between the temperature of the downstream external heating roller and that of the fixing roller is small. As a result, a small amount of heat is transferred from the downstream external heating roller to the fixing roller. Therefore, the time of supplying power to the heat generation member becomes short. In this case, the downstream heating roller is heated for a shorter period of time. Accordingly, the surface temperature of the fixing roller may become uneven.

SUMMARY OF THE INVENTION

The present invention is directed to an image heating apparatus including a plurality of external heating members that can suppress or reduce uneven surface temperature of a fixing roller, which serves as an image heating rotational member.

According to an aspect of the present invention, an image heating apparatus includes an image heating rotational member configured to heat an image on a recording material, a pressure member configured to form a nip portion with the image heating rotational member and pinches the recording material heated by the image heating rotational member in the nip portion, a first external heater including a first heat generation member and configured to contact an outer surface of the image heating rotational member and heat an area of the image heating rotational member that has passed the nip portion, and a second external heater including a second heat generation member and configured to contact an outer surface of the image heating rotational member and heat an area of the image heating rotational member heated by the first external heater. In the image heating apparatus, maximum power applied to the second heat generation member is smaller than maximum power applied to the first heat generation member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to describe the principles of the present invention.

DETAILED DESCRIPTION OF THE EMBODIMENTS

Various exemplary embodiments, features, and aspects of the present invention will now be herein described in detail below with reference to the drawings. It is to be noted that the relative arrangement of the components, the numerical expressions, and numerical values set forth in these embodiments are not intended to limit the scope of the present invention.

Figure 1:
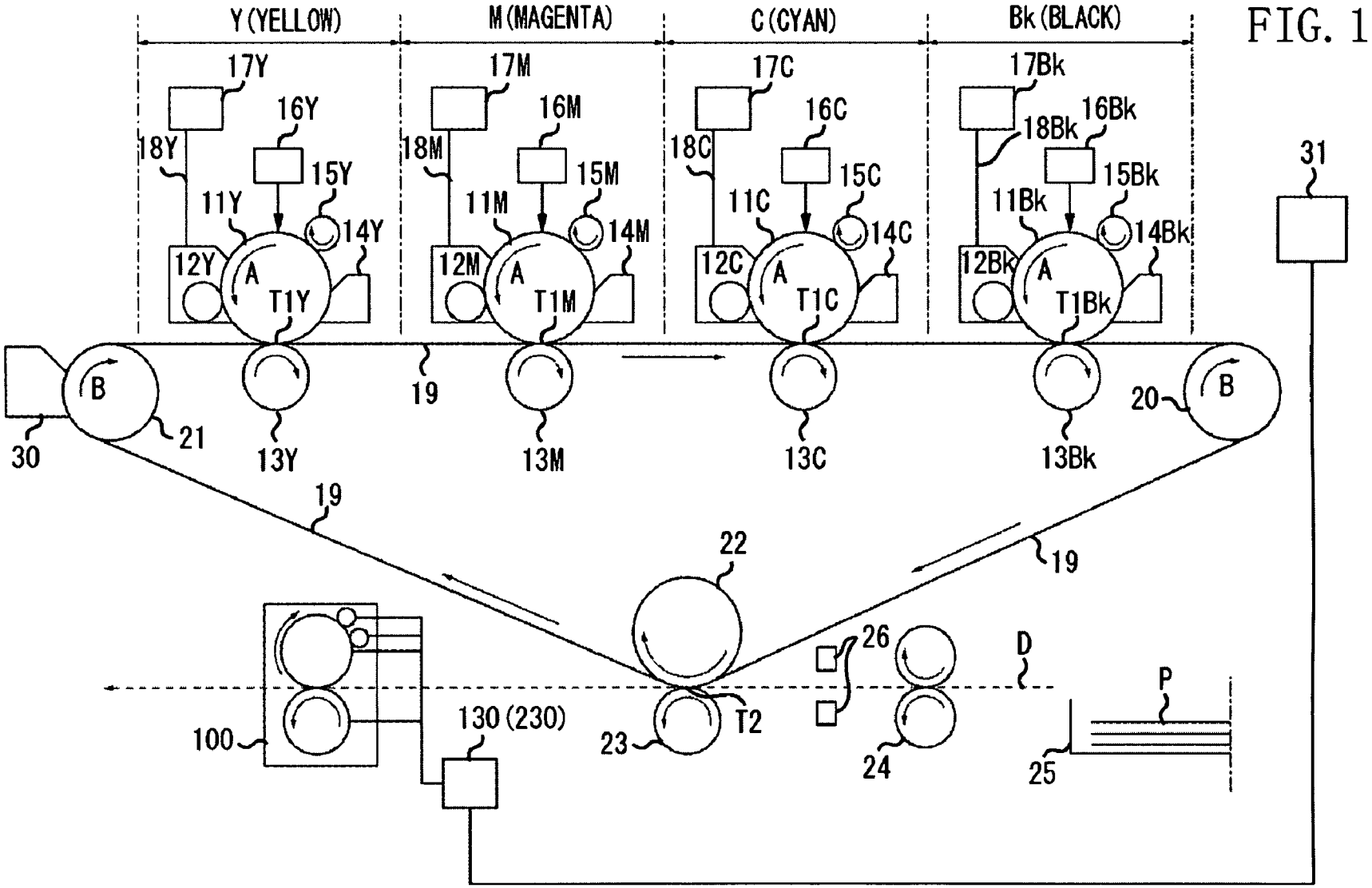
FIG. 1 is a cross section illustrating an example of an image forming apparatus according to first and second exemplary embodiments of the present invention.

FIG. 1 illustrates an exemplary outline configuration of a toner image forming apparatus according to a first exemplary embodiment. Referring to FIG. 1, the toner image forming apparatus includes four image forming units Y (yellow), M (magenta), C (cyan), and Bk (black), which are configured to form each of four mutually different color toner images. In addition, the toner image forming apparatus includes an endless intermediate transfer belt (intermediate transfer member) 19, which is provided inside the toner image forming apparatus extensively from an upper portion to a lower portion thereof.

The four image forming units Y, M, C, and Bk have the same configuration. Accordingly, in the following description, the configuration of the image forming unit Y for yellow will be described in detail as a typical unit representing the four units. With respect to the other three image forming units, members and components thereof that have the same configuration as the image forming unit Y are provided with the same reference numbers and different suffixes representing each unit.

A cylinder-shaped electrophotographic photosensitive member (hereinafter simply referred to as a "photosensitive drum") (image bearing member) 11Y, whose surface layer is made of organic photoconductor (OPC), is driven and rotated in a direction indicated by an arrow A in FIG. 1.

A charging roller 15Y evenly and uniformly charges the surface of the photosensitive drum 11Y. A predetermined bias is applied to the charging roller 15Y. The charging roller 15Y contacts the photosensitive drum 11Y to be driven and rotated thereby. Thus, the charging roller 15Y charges the surface of the photosensitive drum 11Y to a predetermined potential.

The charged photosensitive drum 11Y is exposed to exposure light (laser beam, for example) from an exposure device 16Y. Thus, an electrostatic latent image corresponding to a color separation image of an input document is formed on the photosensitive drum 11Y.

A development device 12Y develops the electrostatic latent image with a toner charged by a development roller to form a toner image corresponding to the electrostatic latent image on the surface of the photosensitive drum 11. The toner image on the photosensitive drum 11Y is primarily transferred by a primary transfer roller 13Y, to which a predetermined bias has been applied, onto the intermediate transfer belt 19, which rotates at substantially the same speed as the rotational speed of the photosensitive drum 11Y, in a primary transfer nip portion (primary transfer portion) T1Y.

After the toner image has been primarily transferred on the intermediate transfer belt 19, primary transfer toner remaining on the photosensitive drum 11Y is collected by a photosensitive drum cleaning device 14Y having a blade or a brush.

The photosensitive drum 11Y from which the primary transfer residual toner has been removed is evenly and uniformly charged again by the charging roller 15Y to be used for forming another image. A toner replenishment device 17Y sequentially supplies toner to the development device 12Y via a replenishment path 18Y.

The intermediate transfer belt 19 is stretched around a driving roller 20, a supporting roller 21, and a backup roller 22. The intermediate transfer belt 19 is driven and rotated by the driving roller 20 in a rotational direction indicated by an arrow B in FIG. 1 while contacting photosensitive drums 11Y, 11M, 11C, and 11Bk of the four image forming units Y, M, C, and Bk.

The intermediate transfer belt 19 is pinched between primary transfer rollers 13Y, 13M, 13C, and 13Bk and the photosensitive drums 11Y, 11M, 11C, and 11Bk. Thus, primary transfer nip portions T1Y, T1M, T1C, and T1Bk are formed between the photosensitive drums 11Y, 11M, 11C, and 11Bk and the intermediate transfer belt 19.

When a full color mode (full color image forming mode) is selected, the above-described image forming operation is executed by each of the four image forming units Y, M, C, and Bk. Then, the yellow toner image, the magenta toner image, the cyan toner image, and the black toner image, which have been formed on the photosensitive drums 11Y, 11M, 11C, and 11Bk, are serially transferred on the intermediate transfer belt 19 in an overlapping manner. The color order is not limited to the above-described order and can be arbitrarily set according to the type of the image forming apparatus.

Then, the toner images transferred on the intermediate transfer belt 19 in the overlapping manner are secondarily transferred on a recording material (transfer material) P in a collective manner at a secondary transfer nip T2, which has been formed between the intermediate transfer belt 19 backed up by the backup roller 22 and the secondary transfer roller 23. The secondary transfer is executed by applying a predetermined bias to the secondary transfer roller 23. The recording material P is separated and fed sheet by sheet from a paper feed cassette 25. The separated and fed recording material P is supplied to the secondary transfer nip T2 by a registration roller pair 24 at predetermined control timing.

The recording material P having the secondary-transferred toner image thereon is then guided into a fixing device 100 via a conveyance path D. In the fixing device 100, the toner image on the recording material P is applied with pressure and heat. Thus, a full color toner image is fixed on the recording material P.

After the toner image is secondarily transferred on the recording material P, the secondary transfer residual toner on the intermediate transfer belt 19 at the secondary transfer nip T2 is collected by an intermediate transfer belt cleaning device 30 having a blade or a brush. Then, the intermediate transfer belt 19 from which the secondary transfer residual toner has been removed is repeatedly used for the primary transfer for forming a subsequent image.

Furthermore, when a monochromatic printing mode using black only (monochromatic image forming mode) is set or a two-color or three-color printing mode is set, the processing for forming an image on the photosensitive drum is executed by the image forming unit for the designated color. In this case, the image forming units for the other colors are running idle.

Then, the toner image is primarily transferred on the intermediate transfer belt 19 in the primary transfer nip portion T1. The primarily transferred toner image is then secondary-transferred on the recording material P in the secondary transfer nip portion T2. Then, the recording material P having the secondary-transferred toner image thereon is guided into the fixing device 100, which serves as an image heating apparatus.

Figure 2:
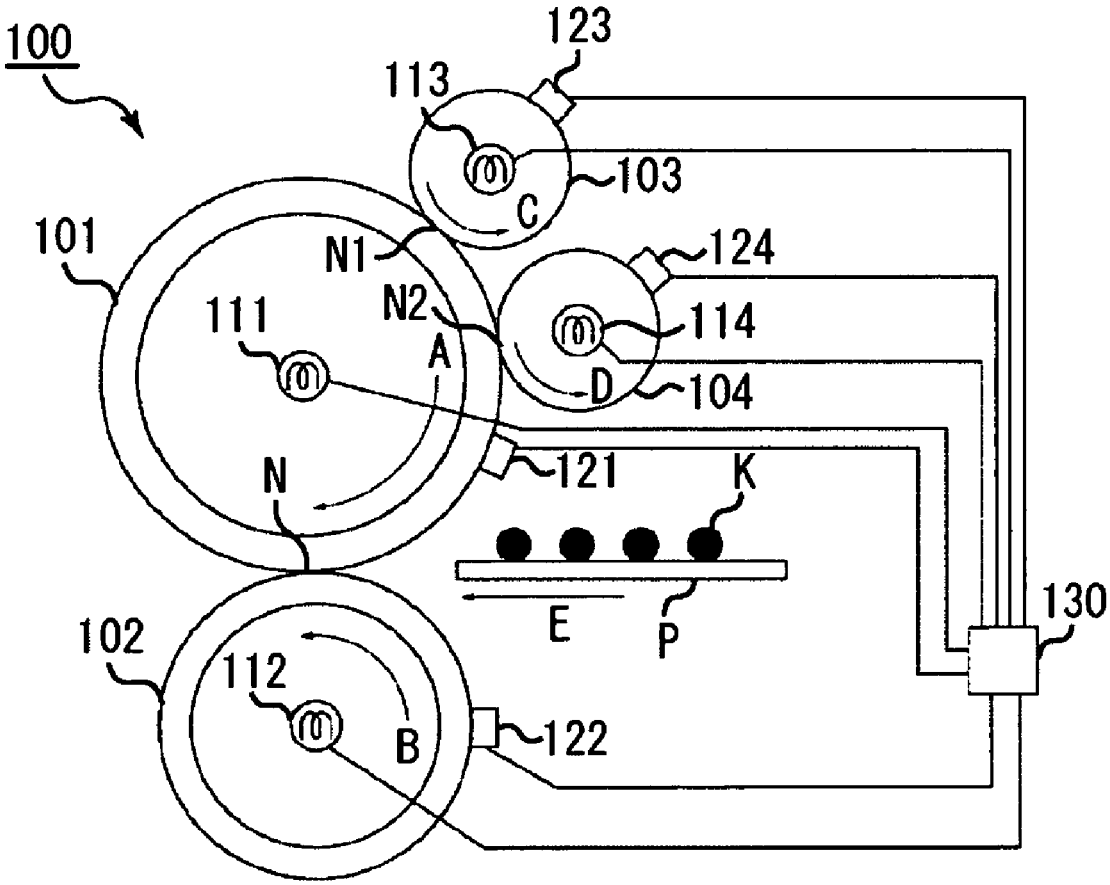
FIG. 2 is a cross section illustrating an example of an external heating type fixing device according to the first exemplary embodiment of the present invention.

As illustrated in FIG. 2, the fixing device 100 is constituted by a fixing roller 101, which serves as an image heating rotational member, a pressure roller 102, which serves as a pressure member, a first external heating roller 103, which serves as a first external heater, and a second external heating roller 104, which serves as a second external heater.

The fixing roller 101 is driven and rotated by a driving source (not illustrated) in the direction indicated with the arrow A in FIG. 1 at a predetermined speed, for example, at a peripheral speed of 500 mm/sec.

Figure 4:
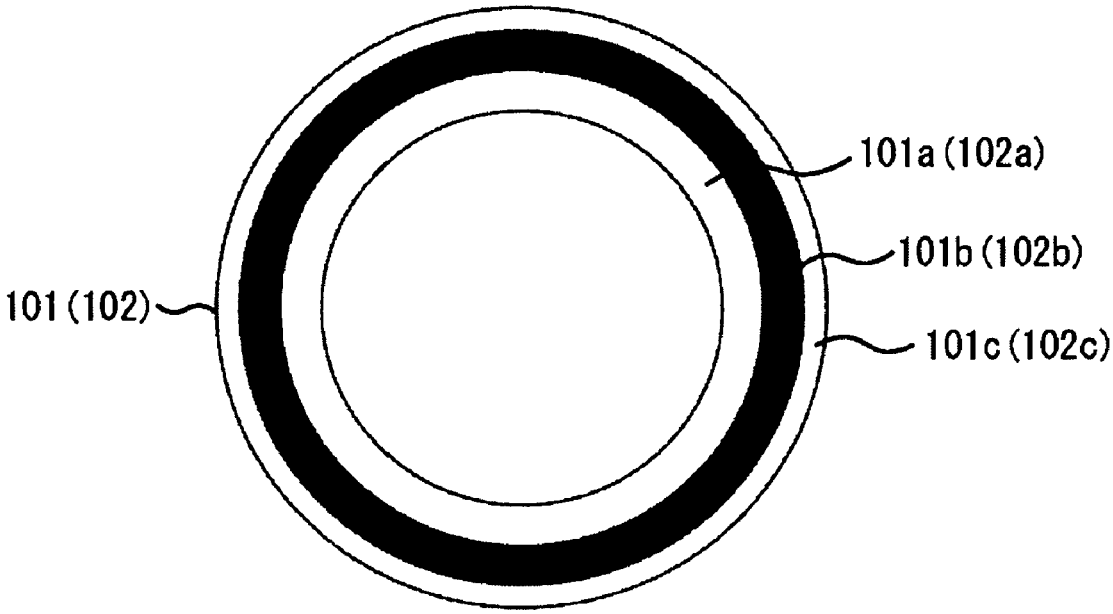
FIG. 4 is a cross section illustrating an example of a fixing roller and a pressure roller according to the first exemplary embodiment of the present invention.

The fixing roller 101 illustrated in FIG. 4 includes a metal (in the present exemplary embodiment, aluminum) core 101*a* having the shape of a cylinder, having an outer diameter of 74 mm, a thickness of 6 mm, and a length of 350 mm. The core 101*a* is coated with a silicon rubber (in the present exemplary embodiment, silicon rubber of 20 degrees Japanese Industrial Standards (JIS)-A rigidity) layer having the thickness of 3 mm, which is formed thereon as a heat resistant elastic layer 101*b*. The elastic layer 101*b* is coated with a fluorine resin (in the present exemplary embodiment, a perfluoro-alkyl-vinyl-ether (PFA) tube) layer having the thickness of 100 μm in order to increase the toner releasing property of the fixing roller 101. The fluorine resin layer is formed on the elastic layer 101*b* as a heat resistant release layer 101*c*.

Returning to FIG. 2, a halogen heater 111 having the normal rated power of 1,200 W is disposed inside the core 101*a* of the fixing roller 101 as a heat generation member. Thus, the fixing roller 101 is internally heated so as to raise the surface temperature of the fixing roller 101 to a predetermined temperature.

The surface temperature of the fixing roller 101 is detected by a thermister 121 that contacts the fixing roller 101. A heater control unit 130 powers on and off the halogen heater 111 according to the detected temperature. Thus, the surface temperature of the fixing roller 101 can be controlled to be at a predetermined target temperature of 200° C., for example.

Figure 3:
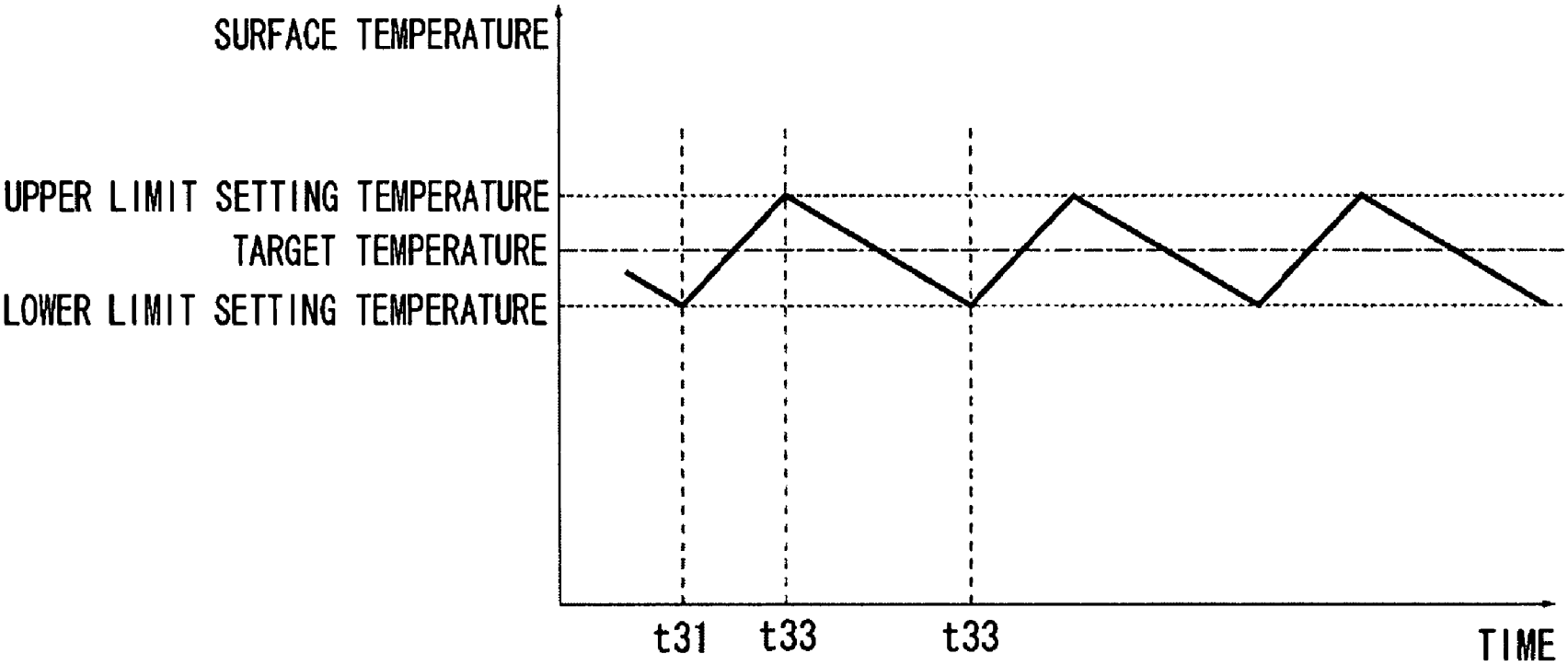
FIG. 3 illustrates an exemplary temperature control method according to the first exemplary embodiment of the present invention.

FIG. 3 illustrates a method for controlling the surface temperature of the fixing roller 101 according to the present exemplary embodiment. When the temperature detected by the thermister 121 decreases to a lower limit setting temperature at time t31, the heater control unit 130 starts the power supply to a halogen heater 113. When the surface temperature of the fixing roller 101 reaches an upper limit setting temperature at time t32, the power supply is discontinued and the halogen heater 113 is powered off.

Figure 18:
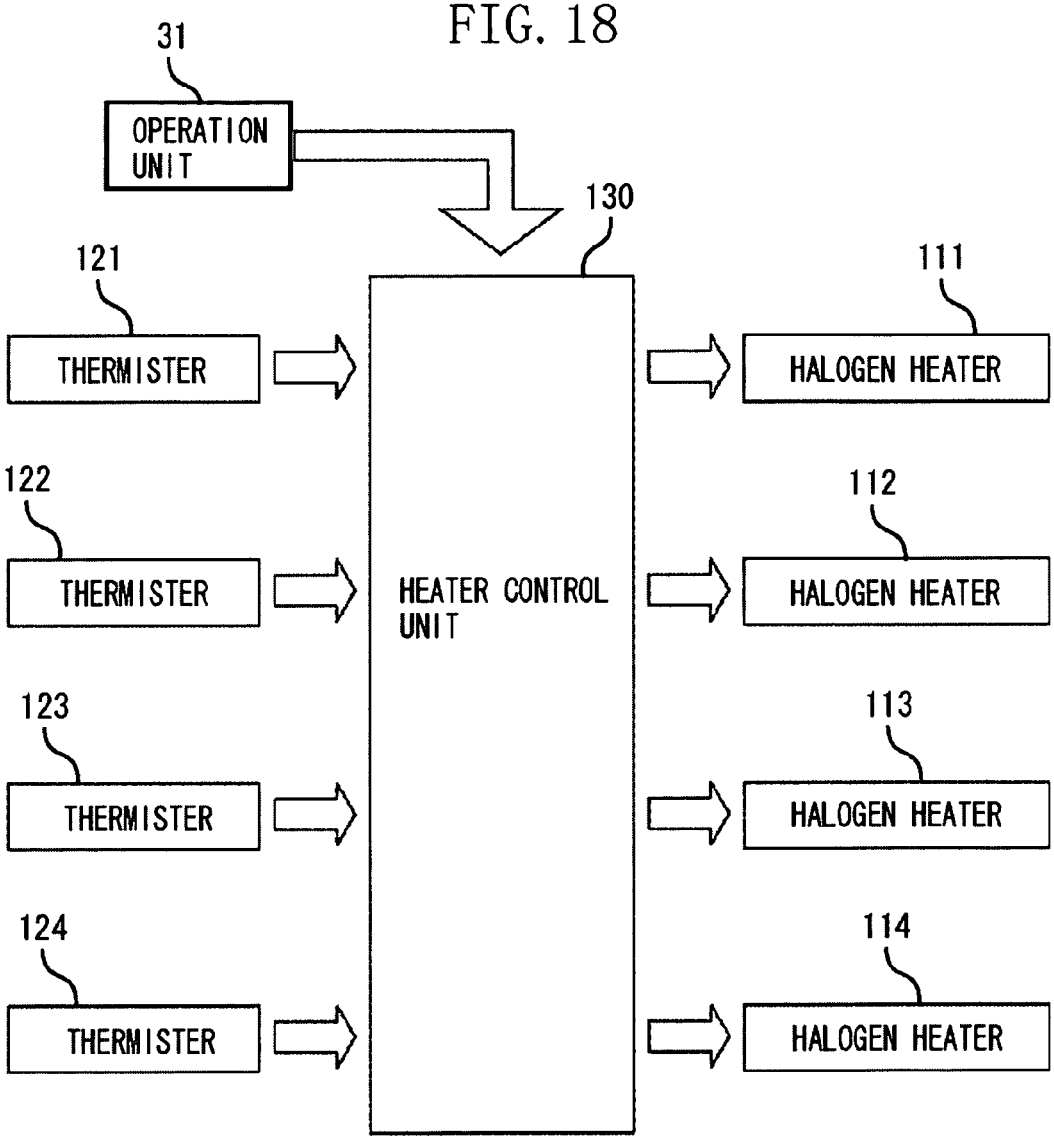
FIG. 18 illustrates an exemplary configuration of a control circuit according to the first exemplary embodiment of the present invention.

Furthermore, when the surface temperature of the fixing roller 101 decreases to the lower limit setting temperature again at time t33, the power supply to the halogen heater 113 is resumed. Thereafter, the above-described sequence is repeated to control the surface temperature of the fixing roller 101. The upper limit setting temperature is set at a temperature 1° C. higher than the target temperature while the lower limit setting temperature is set at a temperature 1° C. lower than the target temperature. In other words, an average of the upper limit setting temperature and the lower limit setting temperature is equal to the target temperature. FIG. 18 illustrates exemplary temperature control according to the present exemplary embodiment.

Returning to FIG. 2, the pressure roller 102 is pressed against the fixing roller 101 by a pressure unit (not illustrated) with a predetermined pressure. The pressure roller 102 forms a nip portion N between the same and the fixing roller 101. The pressure roller 102 is driven and rotated in accordance with the rotation of the fixing roller 101 in a direction indicated by an arrow B in FIG. 2 at a peripheral speed of 500 mm/sec, for example.

Referring to FIG. 4, the pressure roller 102 includes a metal (in the present exemplary embodiment, aluminum) core 102*a* having the shape of a cylinder and having an outer diameter of 54 mm, a thickness of 5 mm, and a length of 350 mm. The core 102*a* is coated with a silicon rubber (in the present exemplary embodiment, silicon rubber of 15 degrees JIS-A rigidity) layer having the thickness of 3 mm. The silicon rubber layer is formed on the core 102*a* as a heat resistant elastic layer 102*b*. The elastic layer 102*b* is coated with a fluorine resin (in the present exemplary embodiment, a PFA tube) layer having the thickness of 100 μm in order to increase the toner releasing property of the pressure roller 102. The fluorine resin layer is formed on the elastic layer 102*b* as a heat resistant release layer 102*c*.

A halogen heater 112 having the normal rated power of 300 W is disposed inside the core 102*a* of the pressure roller 102 as a heat generation member. Thus, the pressure roller 102 is internally heated so as to raise the surface temperature of the pressure roller 102 to a predetermined temperature.

The surface temperature of the pressure roller 102 is detected by a thermister 122 that contacts the pressure roller 102. The heater control unit 130 powers on and off the halogen heater 112 according to the detected temperature. Thus, the surface temperature of the pressure roller 102 can be controlled to be at a predetermined target temperature of 130° C., for example.

The control is executed by the method similar to the control of the surface temperature of the fixing roller 101. More specifically, the upper limit setting temperature is set at a temperature 1° C. higher than the target temperature while the lower limit setting temperature is set at a temperature 1° C. lower than the target temperature.

The recording material P having an unfixed toner K thereon is fed through the nip portion N to fix the toner K on the recording material P. More specifically, the toner K is fixed on the recording material P by pinching the recording material P bearing the unfixed toner K at the nip portion N and applying heat thereto.

The first external heating roller 103 is pressed against the fixing roller 101 by a pressure unit (not illustrated) with a predetermined pressure. The first external heating roller 103 forms a nip portion N1 between the same and the fixing roller 101. The first external heating roller 103 is driven and rotated in accordance with the rotation of the fixing roller 101 in a direction indicated by an arrow C in FIG. 2 at a peripheral speed of 500 mm/sec, for example. More specifically, the first external heating roller 103 contacts the outer surface of the fixing roller 101 to apply heat to the fixing roller 101.

The first external heating roller 103 is an external heating roller disposed upstream of the fixing roller 101.

Figure 5:
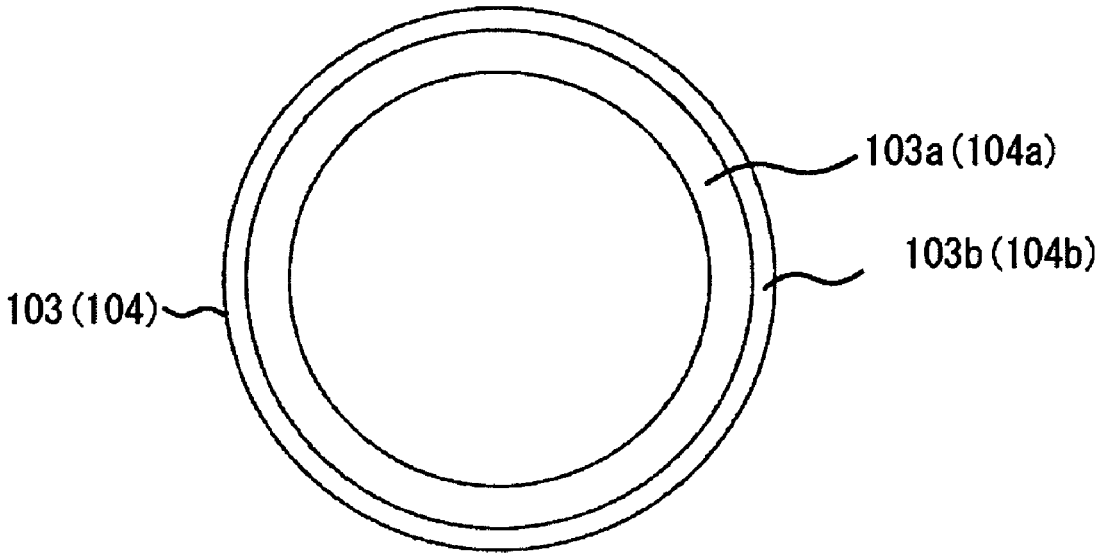
FIG. 5 is a cross section illustrating an example of an external heating roller according to the first exemplary embodiment of the present invention.

As illustrated in FIG. 5, the first external heating roller 103 includes a metal (in the present exemplary embodiment, aluminum) core 103*a* having the shape of a cylinder, having an outer diameter of 30 mm, a thickness of 3 mm, and a length of 350 mm. The core 103*a* is coated with a fluorine resin (in the present exemplary embodiment, a PFA tube) layer having the thickness of 20 μm in order to increase the toner releasing property of the first external heating roller 103. The fluorine resin is formed on the core 103*a* as a heat resistant release layer 103*b*.

In addition, the halogen heater 113 having the normal rated power of 1,000 W is disposed inside the core 103*a* of the first external heating roller 103 as a first heat generation member. Thus, the first external heating roller 103 is internally heated so as to raise the surface temperature of the first external heating roller 103 to a predetermined temperature. A first external heater is constituted by the first external heating roller 103 and the halogen heater 113.

The surface temperature of the first external heating roller 103 is detected by a thermister 123 that contacts the first external heating roller 103. The heater control unit 130 powers on and off the halogen heater 113 according to the detected temperature. Thus, the surface temperature of the first external heating roller 103 can be controlled to be at (adjusted to) a predetermined target temperature of 220° C., for example.

The control is executed by the method similar to the control of the surface temperature of the fixing roller 101. More specifically, the upper limit setting temperature is set to be at a temperature 1° C. higher than the target temperature while the lower limit setting temperature is set to be at a temperature 1° C. lower than the target temperature.

The second external heating roller 104 has substantially the same configuration as that of the first external heating roller 103. The second external heating roller 104 is pressed against the fixing roller 101 by a pressure unit (not illustrated) with a predetermined pressure. The second external heating roller 104 forms a nip portion N2 between the same and the fixing roller 101. The second external heating roller 104 is driven and rotated in accordance with the rotation of the fixing roller 101 in a direction indicated by an arrow D in FIG. 2 at the peripheral speed of 500 mm/sec, for example. The second external heating roller 104 is an external heating roller disposed downstream of the fixing roller 101 in the rotational direction.

The second external heating roller 104 also contacts the outer surface of the fixing roller 101 to heat the fixing roller 101. The second external heating roller 104 is disposed downstream of the first external heating roller 103 in the rotational direction of the fixing roller 101. Thus, the second external heating roller 104 heats an area of the fixing roller 101 heated by the first external heating roller 103.

As illustrated in FIG. 5, the second external heating roller 104 includes a metal (in the present exemplary embodiment, aluminum) core 104*a* having the shape of a cylinder and having an outer diameter of 30 mm, a thickness of 3 mm, and a length of 350 mm. The core 104*a* is coated with a fluorine resin (in the present exemplary embodiment, a PFA tube) layer having the thickness of 20 μm in order to increase the toner releasing property of the second external heating roller 104. The fluorine resin layer is formed on the core 104*a* as a heat resistant release layer 104*b*.

Returning to FIG. 2, a halogen heater 114 having the normal rated power of 600 W is disposed inside the core 104*a* of the second external heating roller 104 as a second heat generation member. Thus, the second external heating roller 104 is internally heated so as to raise the surface temperature of the second external heating roller 104 to a predetermined temperature. A second external heater is constituted by the second external heating roller 104 and the halogen heater 114.

The surface temperature of the second external heating roller 104 is detected by a thermister 124 that contacts the second external heating roller 104. The heater control unit 130 powers on and off the halogen heater 114 according to the detected temperature. Thus, the surface temperature of the second external heating roller 104 can be controlled to be at (adjusted to) a predetermined target temperature of 220° C., for example.

The control also is executed by the method similar to the control of the surface temperature of the fixing roller 101. More specifically, the upper limit setting temperature is set to be at a temperature 1° C. higher than the target temperature while the lower limit setting temperature is set at a temperature 1° C. lower than the target temperature.

In the present exemplary embodiment, the first external heating roller 103 and the second external heating roller 104 exert the same pressure on the fixing roller 101. In addition, the nip portions N1 and N2 have the same nip width.

The surface temperature of the first external heating roller 103 and the second external heating roller 104 is controlled to be at (adjusted to) the same target temperature. In the present specification, the term "the same target temperature" refers to a target temperature having a margin of tolerable range of ±5° C.

Each roller is controlled to be pressed and separated according to the present exemplary embodiment as described in detail below.

When the toner image forming apparatus is in a standby mode, the pressure roller 102, the first external heating roller 103, and the second external heating roller 104 are separated from the fixing roller 101 by a separation unit (not illustrated) in order to prevent the elastic layer 101*b* of the fixing roller 101 and the elastic layer 102*b* of the pressure roller 102 from deforming or warping.

During printing, namely, during an operation for fixing (heating) an image on a recording material, the pressure roller 102, the first external heating roller 103, and the second external heating roller 104 are pressed against the fixing roller 101 by the pressure unit (not illustrated).

If each roller is pressed against the fixing roller 101 in the standby mode without being separated therefrom, the remaining deformation or the warping of the elastic layer in the nip portions N. N1, and N2 is adversely reflected on the image during a printing process. In this case, an image failure such as a horizontal streak or a gloss streak (uneven gloss) may occur, which may degrade the image quality. In order to address this problem, it is useful to separate each roller from the fixing roller 101 during the standby mode as shown in the present exemplary embodiment.

Now, the power supplied to a heat source (the halogen heaters 113 and 114) of the external heating roller according to the present exemplary embodiment will be described in detail below. In the following description, comparative examples 1 through 3, in which the halogen heaters 113 and 114 have normal rated power different from the present exemplary embodiment, will be described.

In the present exemplary embodiment and the comparative examples 1 through 3, the power equivalent to the normal rated power of the halogen heaters 113 and 114 is supplied to each halogen heater.

Figure 6:
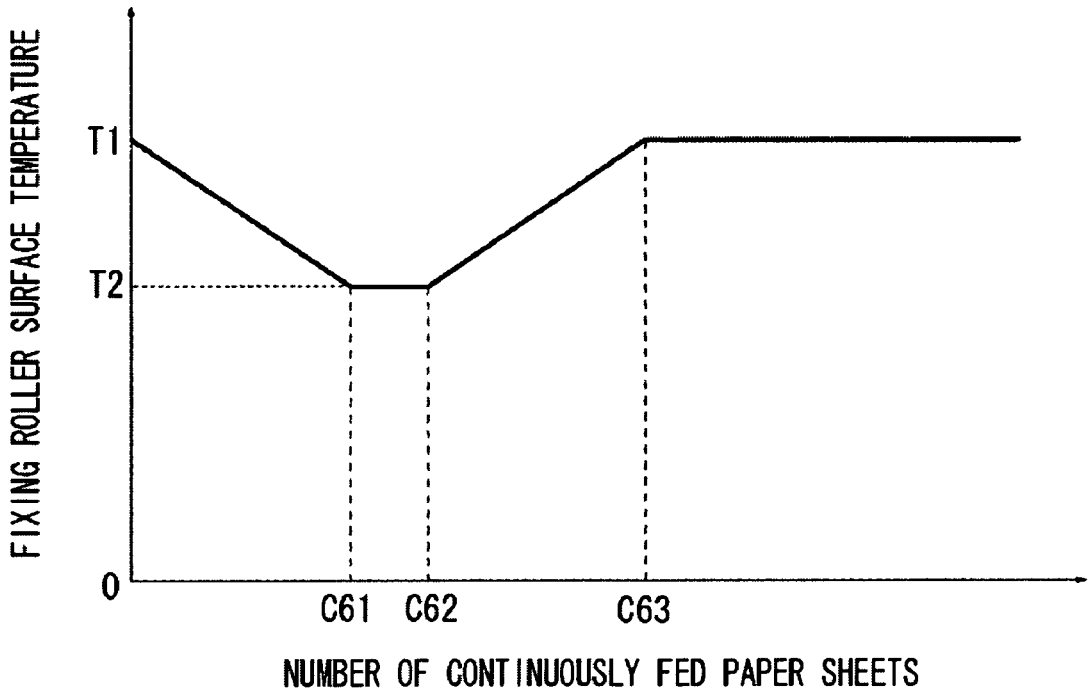
FIG. 6 illustrates the variation in the surface temperature of a fixing roller detected by a thermister when thick paper sheets are serially fed according to a comparative example 1 and an exemplary embodiment of the present invention.
Figure 7:
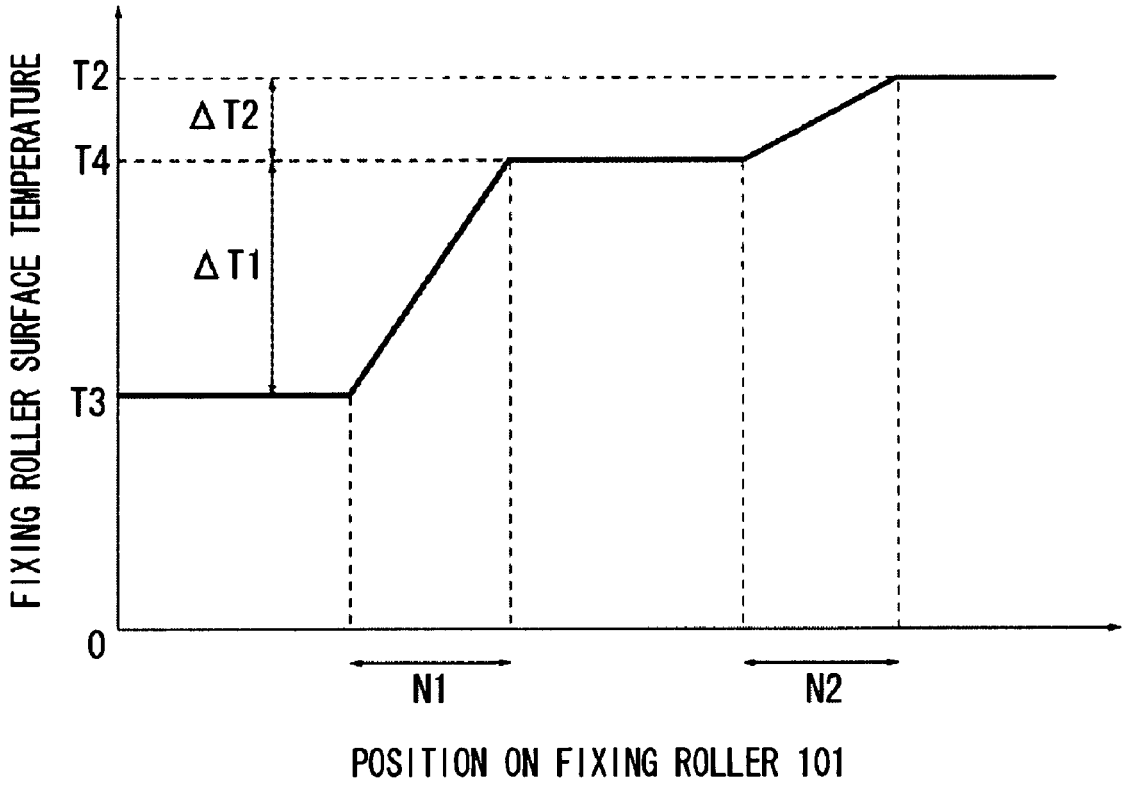
FIG. 7 illustrates fixing roller surface temperature values across a nip N1 and across a nip N2 measured with a temperature measuring device (not illustrated) (a thermo viewer, for example) according to the comparative example 1 and an exemplary embodiment of the present invention.

FIG. 6 illustrates the variation in the surface temperature of the fixing roller 101 detected by the thermister 121 when thick paper sheets are serially fed according to the present exemplary embodiment and the comparative example 1. FIG. 7 illustrates the surface temperature of the fixing roller 101 before and after passing the nip portion N1 and the nip portion N2 measured with a temperature measurement device (not illustrated) (a thermo viewer, for example) according to the comparative example 1 and the present exemplary embodiment.

Figure 8:
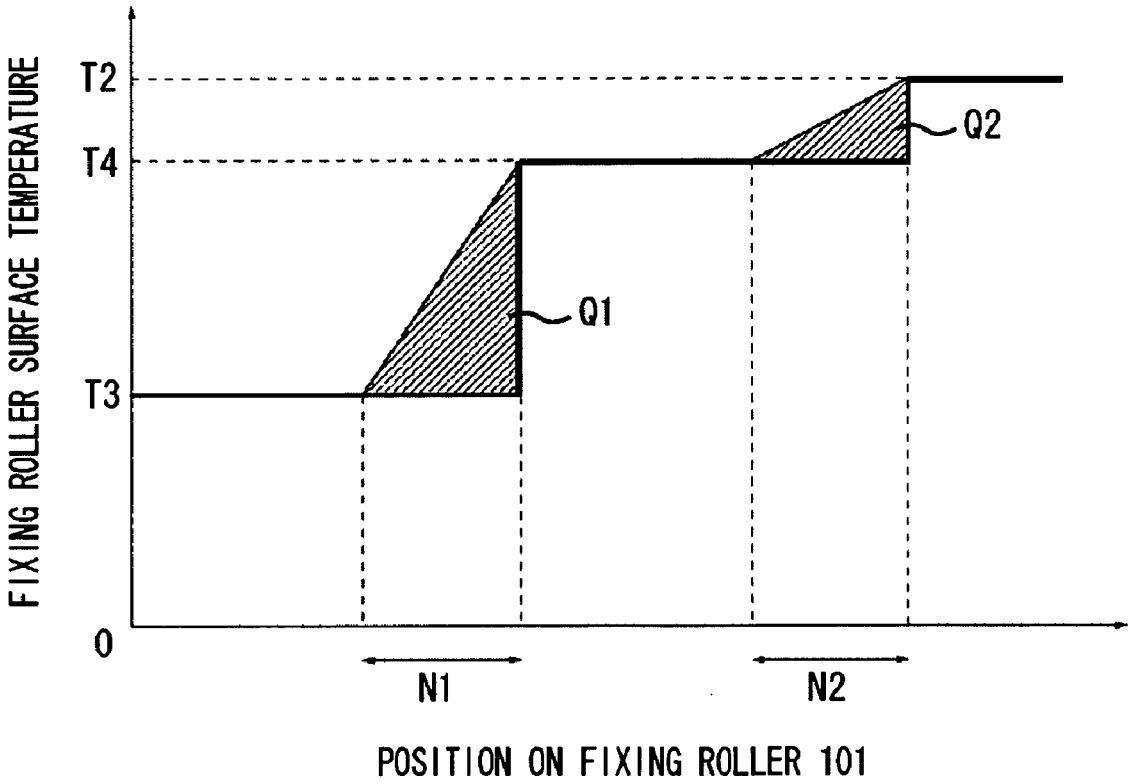
FIG. 8 illustrates supply of the heat amount from an external heating roller to a fixing roller according to the comparative example 1 illustrated in FIG. 5 and an exemplary embodiment of the present invention.
Figure 9:
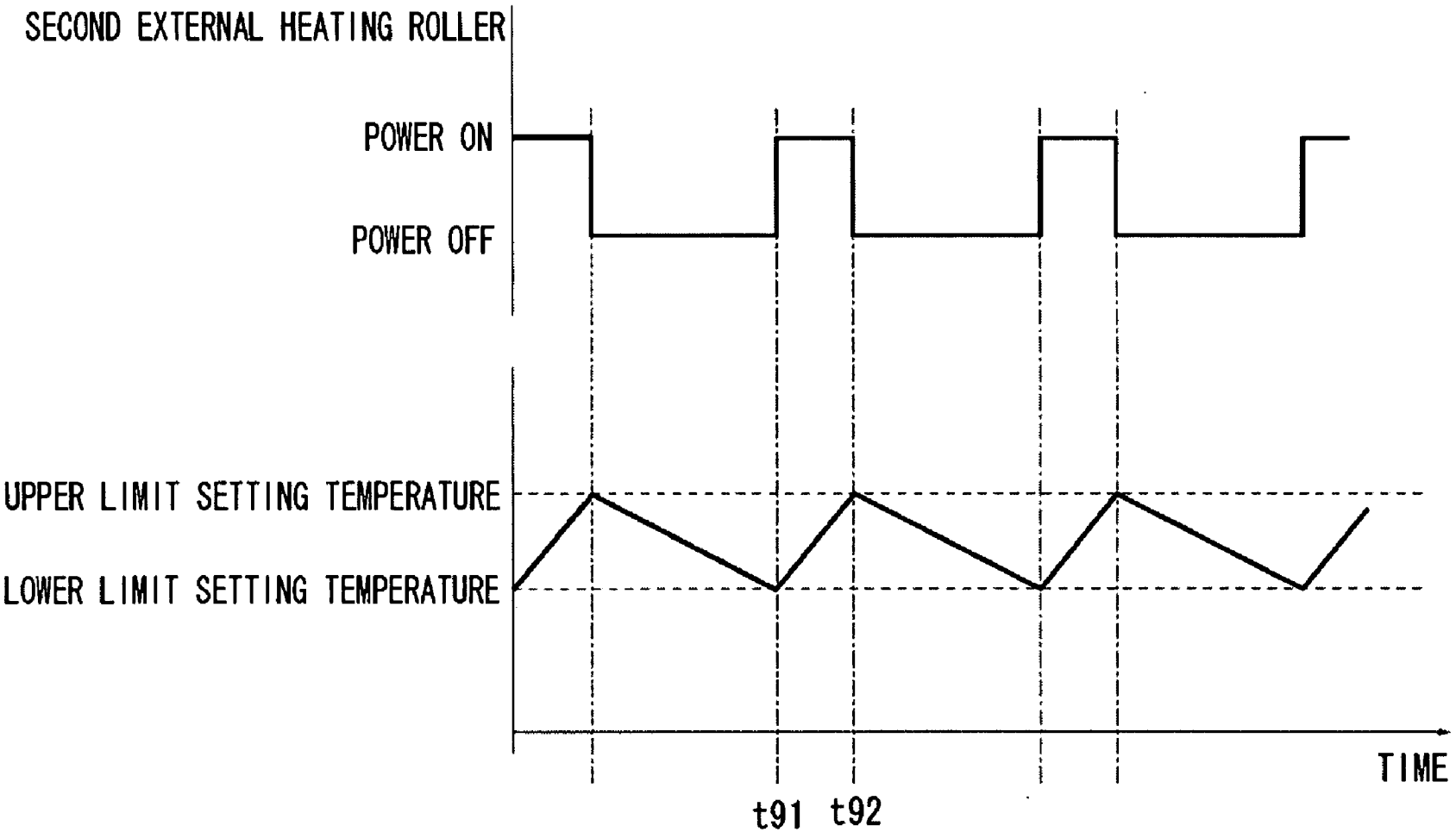
FIG. 9 illustrates the relationship between the supply of power and the discontinuation of the power supply to a halogen heater of a second heating member and the temperature variation according to the comparative example 1.

FIG. 8 illustrates the amount of heat supplied from the external heating rollers 103 and 104 to the fixing roller 101 according to the present exemplary embodiment and the comparative example 1. FIG. 9 illustrates the relationship between the supply of power and the discontinuation of the power supply to the halogen heater 114 of the second heating member 104 and the temperature variation according to the comparative example 1.

Figure 10:
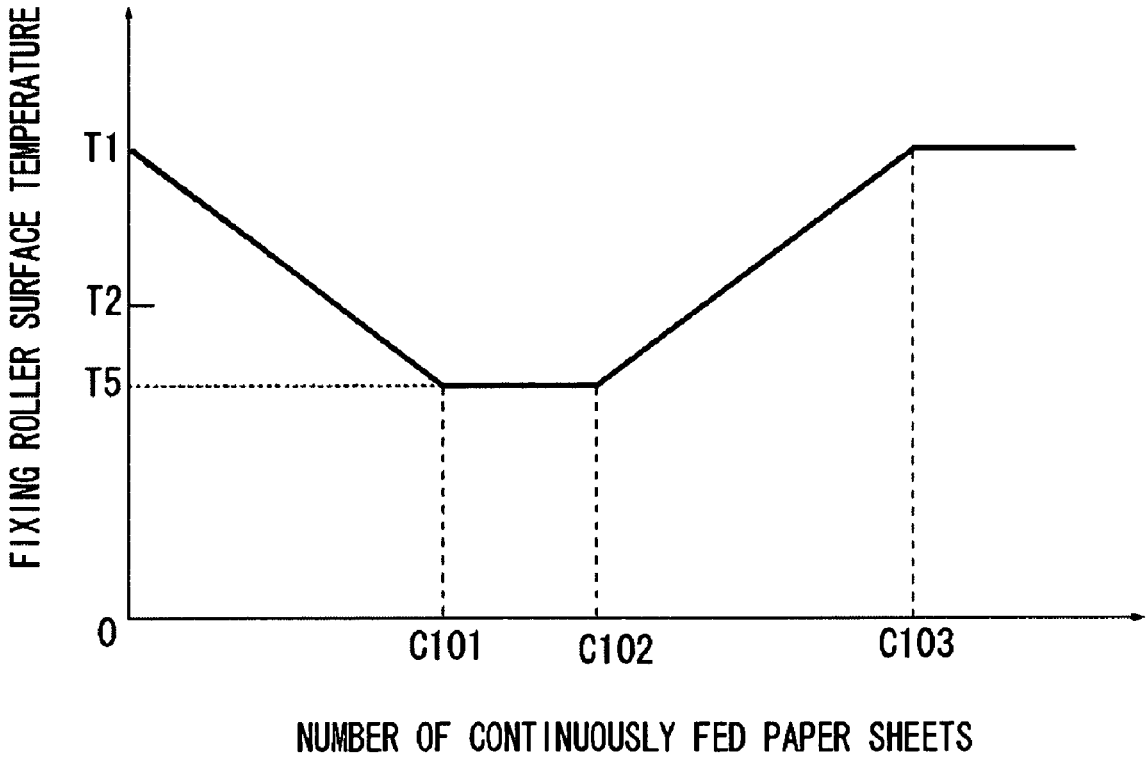
FIG. 10 illustrates the variation in a fixing roller surface temperature detected by a thermister when thick paper sheets are serially fed according to comparative examples 2 and 3 of the present invention.
Figure 11:
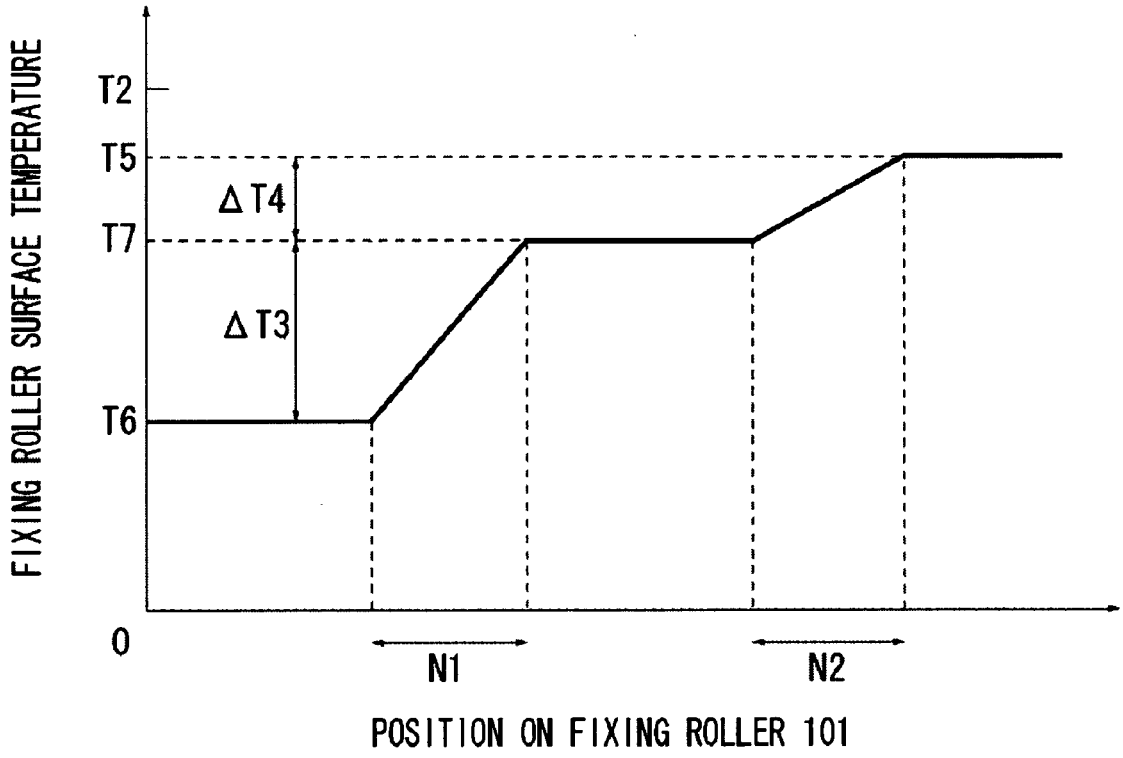
FIG. 11 illustrates surface temperature values of a fixing roller across the nip portion N1 and across the nip portion N2 measured by a temperature measurement device (not illustrated) (a thermo viewer, for example) according to the comparative examples 2 and 3 of the present invention.

FIG. 10 illustrates the variation in the surface temperature of the fixing roller 101 detected by the thermister 121 that occurs when thick paper sheets are serially fed according to the comparative examples 2 and 3. FIG. 11 illustrates the fixing roller surface temperature before and after passing the nip portion N1 and the nip portion N2 measured with the temperature measurement device (not illustrated) (a thermo viewer, for example) according to the comparative examples 2 and 3.

Figure 12:
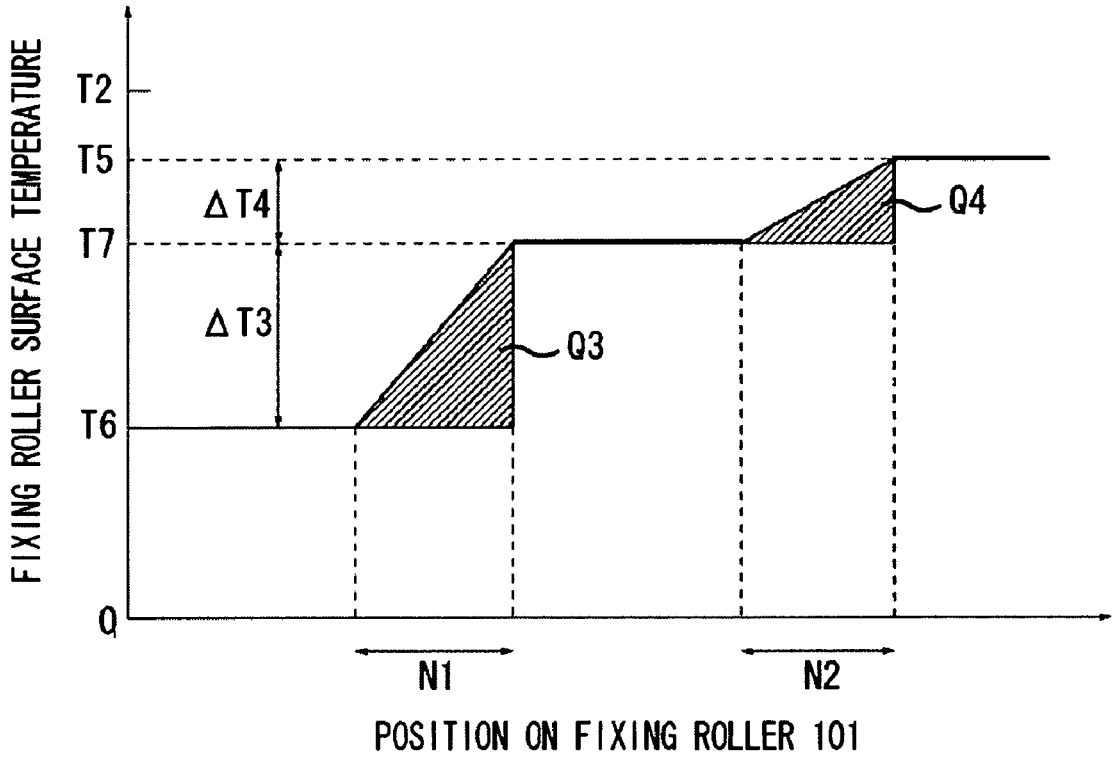
FIG. 12 illustrates supply of the heat amount from an external heating roller to a fixing roller according to the comparative examples 2 and 3 illustrated in FIG. 8.
Figure 13:
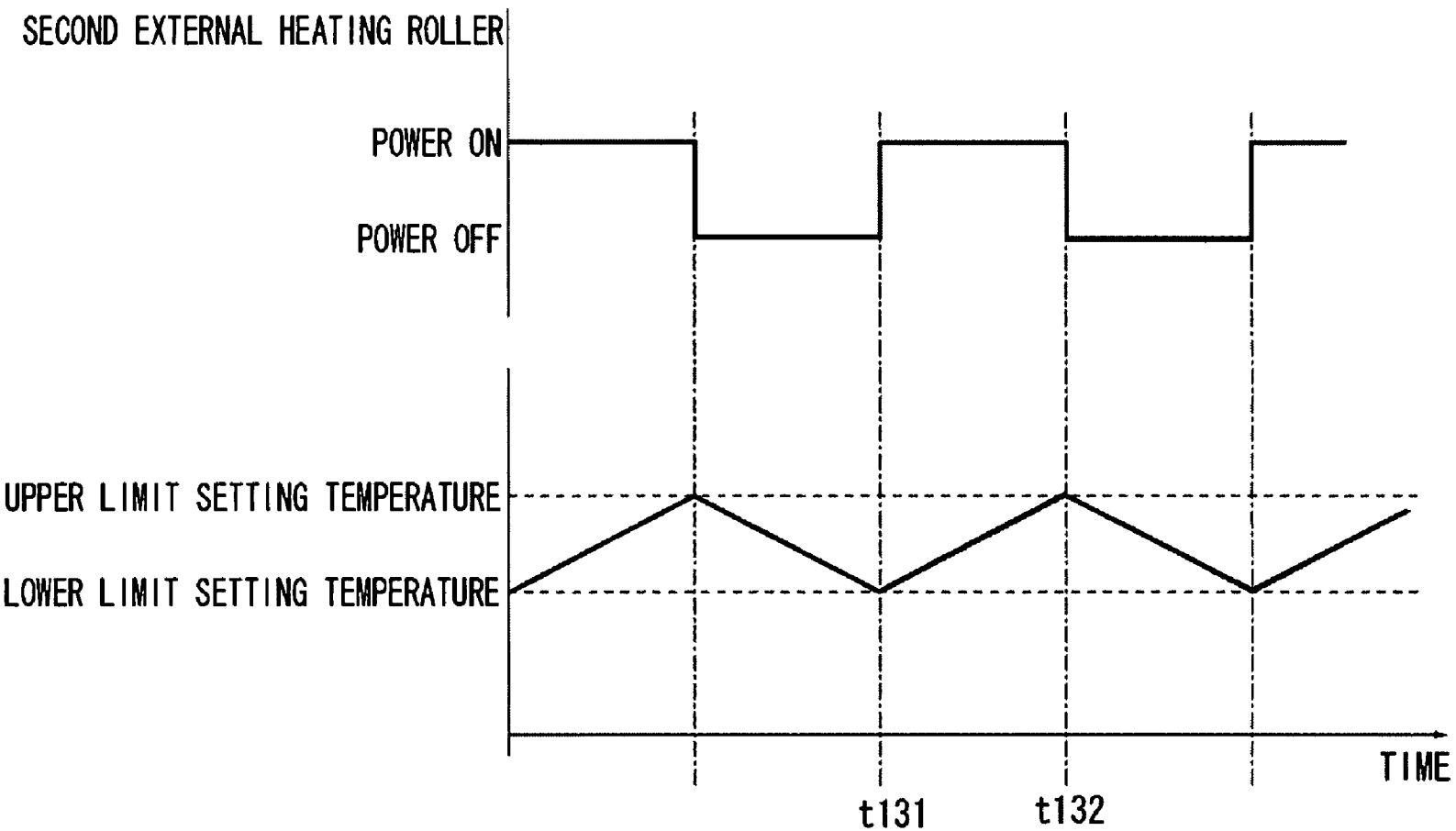
FIG. 13 illustrates the relationship between the supply of power and the discontinuation of the power supply to the halogen heater of the second heating member and the temperature variation according to the first exemplary embodiment of the present invention.

FIG. 12 illustrates the amount of heat supplied by the external heating roller to the fixing roller 101 according to the comparative examples 2 and 3. FIG. 13 illustrates the relationship between the supply of power and the discontinuation of the power supply to the halogen heater 114 by the second external heating roller 104 and the temperature variation according to the present exemplary embodiment.

In the following comparative examples of the present exemplary embodiment, A4 size thick paper sheets (recording materials) having a grammage of 300 g/m$^2$ were serially fed in a landscape orientation thereof at a printing speed of 100 pages per minute (ppm).

(1) Power Supplied in Comparative Example 1

First, the comparative example 1 will be described where the normal rated power of the halogen heater 113 of the first external heating roller 103=1,000 W and the normal rated power of the halogen heater 114 of the second external heating roller 104=1,000 W. In the comparative example 1, the normal rated power of the halogen heater 111 of the fixing roller 101=1,200 W and the normal rated power of the halogen heater 112 of the pressure roller 102=300 W. Accordingly, the normal rated power of the entire fixing device=3,500 W.

FIG. 6 illustrates the variation in the temperature of the fixing roller 101 after printing has been started according to the comparative example 1. The temperature of the fixing roller 101, which has been adjusted to a temperature T1 in the standby mode, decreases when the printing is started and the recording material reaches the nip portion N. The surface temperature of the fixing roller 101 decreases to reach a lowest temperature T2 when a number of fed paper sheets passes C61. In the present exemplary embodiment, T1=200° C. and T2=180° C. This is because even when the halogen heater 111 is powered on to keep the surface temperature of the fixing roller 101 at the temperature T1, the heat is shielded by the core or the elastic layer 101*b* having a low thermal conductivity, and the rise of the surface temperature of the fixing roller 101 is delayed.

When a number of fed paper sheets exceeds C62, the temperature of the fixing roller 101 rises from the lowest temperature T2 to reach the temperature T1 at a number of fed paper sheets C63. After that, the surface temperature of the fixing roller 101 becomes stable (equilibrium state). Here, the lowest temperature T2 is a lower limit of a tolerable range of the temperature that shows satisfying fixing property. In the comparative example 1, the fixing property was within the tolerable range at the lowest temperature T2.

The following temperatures were detected by each of the thermisters 122 through 124 when the temperature of the fixing roller 101=T2. More specifically, the temperature of the first external heating roller 103=220° C., the temperature of the second external heating roller 104=220° C., and the temperature of the pressure roller 102=100° C.

In FIG. 7, the surface temperature of the fixing roller 101 before and after passing the nip portion N1 and the nip portion N2 at the temperature T2 measured by a thermo viewer (not illustrated) are illustrated. As can be known from FIG. 7, the surface temperature of the fixing roller 101 rose from T3 to T4 at the nip N1 and further rose from T4 to T2 at the nip N2. Accordingly, it was found that if a temperature rise $\Delta T1=T4-T3$ and a temperature rise $\Delta T2=T2-T4$, then $\Delta T1>\Delta T2$.

As a result of measuring the amount of power (Wh) consumed by the external heating roller at the lowest temperature T2, the amount of power consumed by the first external heating roller 103=W1 and the amount of power consumed by the second external heating roller 104=W2. Inconsequence, it was found that W1>W2.

The amount of power (Wh: the amount of consumed power in a unit time) consumed by the heat source of each roller can be measured by measuring cumulative amount of power when recording materials pass through the rollers. The amount of power is measured by a commercially available cumulative power consumption amount measuring device installed on each heat source of each roller.

The above results were obtained for the following reasons. As illustrated in FIG. 8, the amount of heat consumed by the external heating roller is calculated by integrating the temperature rise values $\Delta T1$ and $\Delta T2$. More specifically, the amount of heat consumed by the first external heating roller 103 is represented by Q1 and the amount of heat consumed by the second external heating roller 104 is represented by Q2 in which a condition "Q1>Q2" is satisfied.

Although the first external heating roller 103 and the second external heating roller 104 have the same nip width (N1=N2) and the same roller temperature (220° C.), the amount of heat transferred from each of the external heating rollers 103 and 104 to the fixing roller 101 differs. More specifically, the amount of heat transferred from the first external heating roller 103 to the fixing roller 101 is larger than that transferred from the second external heating roller 104 to the fixing roller 101 since the amount of heat transferred from the external heating roller that contacts the fixing roller 101 when the surface temperature of the fixing roller 101 is low is larger than the amount of heat transferred from the other external heating roller. More specifically, the heat is more easily transferred to the fixing roller 101 from the first external heating roller 103 which contacts the fixing roller 101 when the surface temperature of the fixing roller 101 is lower.

In other words, the amount of heat transferred from each of the external heating rollers 103 and 104 differs because the amount of heat transferred from the second external heating roller 104 after the surface temperature of the fixing roller 101 has been raised to a higher temperature by the first external heating roller 103 in the nip portion N1, is smaller than the amount of heat transferred from the first external heating roller 103 (i.e., the heat is less easily transferred from the second external heating roller 104 to the fixing roller 101).

More specifically, the amount of heat transferred from the external heating roller to the fixing roller 101 (the amount of rise in the surface temperature of the fixing roller 101 ($\Delta T$)) becomes larger as the difference between the temperature of the external heating roller and that of the fixing roller 101 increases. Accordingly, the amount of consumed heat shows Q1>Q2 and the amount of consumed power shows W1>W2.

According to the above-described results, the amount of power consumed by the first external heating roller 103, which is disposed upstream of the fixing roller 101 in the rotational direction of the fixing roller 101, is greater than that consumed by the second external heating roller 104. Accordingly, since the halogen heater 114 of the second external heating roller 104 has the normal rated power of 1,000 W, which exceeds the necessary amount, the normal rated power can be reduced.

FIG. 9 illustrates the supply of power and the discontinuation of the power supply to the halogen heater 114 of the second external heating roller 104 and the variation in the surface temperature of the second external heating roller 104 according to the comparative example 1.

The surface temperature of the second heating roller 104 decreases to the lower limit setting temperature at time t91. At this time, the halogen heater 114 is powered on. The power supplied to the halogen heater 114 is as large as 1,000 W. Accordingly, the surface temperature of the external heating roller 104 reaches the upper limit setting temperature within a short time period from the time t91 to time t92. In this case, the area of the fixing roller 101 that contacts the halogen heater 114, whose temperature is on the rise, becomes small. Therefore, significant unevenness in the surface temperature of the fixing roller 101 may occur.

(2) Power Supplied in Comparative Example 2

Now, the comparative example 2 will be described where the normal rated power of the halogen heater 113 of the first external heating roller 103=600 W and the normal rated power of the halogen heater 114 of the second external heating roller 104=600 W. In the comparative example 2, the normal rated power of the halogen heater 111 of the fixing roller 101=1,200 W and the normal rated power of the halogen heater 112 of the pressure roller 102=300 W. Accordingly, the normal rated power of the entire fixing device=2,700 W.

FIG. 10 illustrates the variation in the temperature of the fixing roller 101 after the printing has been started according to the comparative example 2. The temperature of the fixing roller 101, which has been adjusted to a temperature T1 in the standby mode, decreases when the printing is started and the recording material reaches the nip portion N. The surface temperature of the fixing roller 101 decreases to reach a lowest temperature T5 when a number of fed paper sheets passes C101. In the present exemplary embodiment, T1=200° C.

When the number of fed paper sheets exceeds C102, the temperature of the fixing roller 101 rises from the lowest temperature T5 to reach the temperature T1 at the number of fed paper sheets C103. After that, the surface temperature of the fixing roller 101 becomes stable (equilibrium state). Here, the lowest temperature T5 is lower than the lowest temperature T2 in the comparative example 1 and exceeds the lower limit of the tolerable range for implementing the appropriate fixing. The fixing property was out of the tolerable range.

The following temperature values were detected by each of the thermisters 122 through 124 when the temperature of the fixing roller 101=the lowest temperature T5.

The temperature of the first external heating roller 103=210° C., the temperature of the second external heating roller 104=220° C., and the temperature of the pressure roller 102=100° C. The temperature of the first external heating roller 103 was below the setting temperature of 220° C.

The following temperature values were detected by each of the thermisters 122 through 124 at T1, at which the surface temperature of the fixing roller 101 is substantially stable. The temperature of the first external heating roller 103=220° C., the temperature of the second external heating roller 104=220° C., and the temperature of the pressure roller 102=100° C.

FIG. 11 illustrates the surface temperature values of the fixing roller 101 measured with a thermo viewer (not illustrated) before and after passing the nip portion N1 and the nip portion N2 when the temperature of the fixing roller 101 is at T5.

As can be known from FIG. 11, the surface temperature of the fixing roller 101 rose from T6 to T7 in the nip portion N1. The surface temperature of the fixing roller 101 rose from T7 to T5 in the nip portion N2. Accordingly, it was found that if a temperature rise $\Delta T3=T7-T6$ and a temperature rise $\Delta T4=T5-T7$, then $\Delta T3>\Delta T4$, $\Delta T1>\Delta T3$, and $\Delta T2\approx\Delta T4$.

As a result of measuring the amount of power (Wh) consumed by the external heating roller at the lowest temperature T2, the amount of power consumed by the first external heating roller 103=W3 and the amount of power consumed by the second external heating roller 104=W4. Therefore, it was found that W3>W4, W1>W3, and W2≈W4.

The above results were obtained for the following reasons. As illustrated in FIG. 12, the amount of heat consumed by the external heating roller is calculated by integrating the temperature rise values $\Delta T3$ and $\Delta T4$. More specifically, the amount of heat consumed by the first external heating roller 103 is represented by Q3 and the amount of heat consumed by the second external heating roller 104 is represented by Q4, in which the conditions "Q3>Q4", "Q1>Q3", and "Q2≈Q4" are satisfied.

When the surface temperature of the fixing roller 101 is at the lowest temperature T5, because of the small normal rated power of the halogen heater 113 of the first external heating roller 103, the amount of heat transferred from the first external heating roller 103 to the fixing roller 101 is larger than the amount of heat supplied from the halogen heater 113 to the first external heating roller 103. As a result, the temperature may decrease because the setting temperature cannot be maintained due to the shortage of electric power.

In the comparative example 2, the temperature of the first external heating roller 103 is lower than that in the comparative example 1. Thus, the amount of heat transferred from the first external heating roller 103 to the fixing roller 101 becomes smaller than that in the comparative example 1. Further, the rise in the surface temperature of the fixing roller 101 at the nip N1 has decreased. The amount of heat transferred from the second external heating roller 104 to the fixing roller 101 was substantially the same as that in the comparative example 1. As a consequence, the lowest temperature decreased from T2 to T5 and the fixing property degraded.

Therefore, it was found that the lowest temperature of the fixing roller 101 may greatly vary owing to the normal rated power of the first external heating roller 103, which is disposed upstream of the fixing roller 101 in the rotational direction of the fixing roller 101. and that the normal rated power of the first external heating roller 103 high enough to maintain the setting temperature of the first external heating roller 103 is necessary. Accordingly, if the first external heating roller 103 has the normal rated power of 600 W, it is short of the necessary amount. Therefore, it is necessary to increase the normal rated power of the first external heating roller 103.

(3) Power Supplied in Comparative Example 3

Now, the comparative example 3 will be described where the normal rated power of the halogen heater 113 of the first external heating roller 103=600 W and the normal rated power of the halogen heater 114 of the second external heating roller 104=1,000 W. In the comparative example 3, the normal rated power of the halogen heater 111 of the fixing roller 101=1,200 W and the normal rated power of the halogen heater 112 of the pressure roller 102=300 W. Accordingly, the normal rated power of the entire fixing device=3,100 W. The variation in the temperature of the fixing roller 101 in the comparative example 3 was equivalent to that in the comparative example 2.

A progression of variation in the temperature of the fixing roller 101 in the comparative example 3 will be described below with reference to FIG. 10 again.

The temperature of the fixing roller 101, which has been adjusted to a temperature T1 in the standby mode, decreases when the printing is started and the recording material reaches the nip portion N. The surface temperature of the fixing roller 101 decreases to reach a lowest temperature T5 when a number of fed paper sheets passes C101. Also in the comparative example 3, T1=200° C.

When the number of fed paper sheets exceeds C102, the temperature of the fixing roller 101 rises from the lowest temperature T5 to reach the temperature T1 when a number of fed paper sheets passes C103. After that, the surface temperature of the fixing roller 101 becomes stable (equilibrium state).

The following temperature values were detected by each of the thermisters 122 through 124 when the temperature of the fixing roller 101=the lowest temperature T5. The temperature of the first external heating roller 103=210° C., the temperature of the second external heating roller 104=220° C., and the temperature of the pressure roller 102=100° C. The temperature of the first external heating roller 103 was below the setting temperature of 220° C.

The following temperature values were detected by each of the thermisters 122 through 124 at T1, at which the surface temperature of the fixing roller 101 was substantially stable. The temperature of the first external heating roller 103=220° C., the temperature of the second external heating roller 104=220° C., and the temperature of the pressure roller 102=100° C.

FIG. 11 illustrates the surface temperature of the fixing roller 101 measured with a thermo viewer (not illustrated) before and after passing the nip portion N1 and the nip portion N2 when the temperature of the fixing roller 101 is at T5.

As can be known from FIG. 11, the surface temperature of the fixing roller 101 rose from T6 to T7 in the nip portion N1. The surface temperature of the fixing roller 101 rose from T7 to T5 in the nip portion N2. Accordingly, it was found that if a temperature rise ΔT3=T7−T6 and a temperature rise ΔT4=T5−T7, then ΔT3>ΔT4, ΔT1>ΔT3, and ΔT2≈ΔT4.

As a result of measuring the amount of power (Wh) consumed by the external heating roller at the lowest temperature T2, the amount of power consumed by the first external heating roller 103=W3 and the amount of power consumed by the second external heating roller 104=W4. Therefore, it was found that W3>W4, W1>W3, and W2≈W4.

The above results were obtained for the following reasons. As illustrated in FIG. 12, the amount of heat consumed by the external heating roller is calculated by integrating the temperature rise values ΔT3 and ΔT4. More specifically, the amount of heat consumed by the first external heating roller 103 is represented by Q3 and the amount of heat consumed by the second external heating roller 104 is represented by Q4, in which the conditions "Q3>Q4", "Q1>Q3", and "Q2≈Q4" are satisfied.

When the surface temperature of the fixing roller 101 is at the lowest temperature T5, because of the small normal rated power of the halogen heater 113 of the first external heating roller 103, the amount of heat transferred from the first external heating roller 103 to the fixing roller 101 is larger than the amount of heat supplied from the halogen heater 113. As a result, the temperature may decrease because the setting temperature cannot be maintained due to the shortage of electric power.

In the comparative example 3, the temperature of the first external heating roller 103 is lower than that in the comparative example 1. Thus, the amount of heat transferred from the first external heating roller 103 to the fixing roller 101 becomes smaller than that in the comparative example 1 and the rise in the surface temperature of the fixing roller 101 at the nip N1 has decreased. Because the amount of heat transferred from the second external heating roller 104 to the fixing roller 101 was substantially the same as that in the comparative example 1, the lowest temperature decreased from T2 to T5 and the fixing property degraded.

In the configuration of the comparative example 3, the normal rated power of the halogen heater 114 of the second external heating roller 104 is set as high as 1,000 W. However, the difference between the temperature of the second external heating roller 104 and the halogen heater 111 is small. Accordingly, the amount of heat transferred from the second external heating roller 104 to the halogen heater 111 is small.

Therefore, similar to the comparative example 2, it was found that the lowest temperature of the fixing roller 101 may greatly vary according to the normal rated power of the first external heating roller 103, which is disposed upstream of the fixing roller 101 in the rotational direction of the fixing roller 101 and that the normal rated power of the first external heating roller 103 is required to be high enough to maintain the setting temperature of the first external heating roller 103. In addition, it was found that the power supplied to the second external heating roller 104 needs to be set only at an enough level to maintain the setting temperature of the second external heating roller 104 and that the decrease in the surface temperature of the fixing roller 101 cannot be effectively prevented even if excessively high power is supplied to the second external heating roller 104.

Accordingly, if the first external heating roller 103 has the normal rated power of 600 W, electric power is short of the necessary amount and it is necessary to increase the normal rated power of the first external heating roller 103. On the other hand, if the second external heating roller 104 has the normal rated power of 1,000 W, its power exceeds the necessary amount, and the normal rated power can be reduced.

(4) Power Supplied According to Present Exemplary Embodiment

Now, an exemplary configuration according to the present exemplary embodiment will be described. In the present exemplary embodiment, the normal rated power of the halogen heater 113 of the first external heating roller 103=1,000 W and the normal rated power of the halogen heater 114 of the second external heating roller 104=600 W.

On the other hand, the normal rated power of the halogen heater 111 of the fixing roller 101=1,200 W and the normal rated power of the halogen heater 112 of the pressure roller 102=300 W. Accordingly, the normal rated power of the entire fixing device=3,100 W. The variation in the temperature according to the present exemplary embodiment was equivalent to that in the comparative example 1.

A progression of variation in the temperature of the fixing roller 101 according to the present exemplary embodiment will be described below with reference to FIG. 6 again.

The temperature of the fixing roller 101, which has been adjusted to a temperature T1 in the standby mode, decreases when the printing is started and the recording material reaches the nip portion N. The surface temperature of the fixing roller 101 decreases to reach a lowest temperature T2 when a number of fed paper sheets passes C61. Also in the present exemplary embodiment, T1=200° C. and T2=180° C.

When the number of fed paper sheets exceeds C62*s*, the temperature of the fixing roller 101 rises from the lowest temperature T2 to reach the temperature T1 when a number of fed paper sheets passes C63. After that, the surface temperature of the fixing roller 101 becomes stable (equilibrium state). Here, similar to the comparative example 1, the lowest temperature T2 is a lower limit of a tolerable range of temperatures which satisfy the appropriate fixing property. In the present exemplary embodiment, the appropriate fixing property was obtained at the lowest temperature T2.

In the present exemplary embodiment, similar to the comparative example 1, the following temperature values were detected by each of the thermisters 122 through 124 when the temperature of the fixing roller 101=T2 (i.e., the lowest temperature). The temperature of the first external heating roller 103=220° C., the temperature of the second external heating roller 104=220° C., and the temperature of the pressure roller 102=100° C.

FIG. 7 illustrates the surface temperature of the fixing roller 101 before and after passing the nip portion N1 and the nip portion N2 at the temperature T2 measured by a thermo viewer (not illustrated). As can be known from FIG. 7, as in the comparative example 1, the surface temperature of the fixing roller 101 rose from T3 to T4 at the nip N1 and further rose from T4 to T2 at the nip N2. Accordingly, it was found that if a temperature rise ΔT1=T4−T3 and a temperature rise ΔT2=T2−T4, then ΔT1>ΔT2.

As a result of measuring the amount of power (Wh) consumed by the external heating roller at the lowest temperature T2, the amount of power consumed by the first external heating roller 103=W1 and the amount of power consumed by the second external heating roller 104=W2. Therefore, it was found that W1>W2 as in the comparative example 1.

The above results were obtained for the following reasons similar to the comparative example 1. As illustrated in FIG. 8, the amount of heat consumed by the external heating roller is calculated by integrating the temperature rise values ΔT1 and ΔT2. More specifically, the amount of heat consumed by the first external heating roller 103 is represented by Q1 and the amount of heat consumed by the second external heating roller 104 is represented by Q2, in which the condition "Q1>Q2" is satisfied.

FIG. 13 illustrates the relationship between the supply of power and the discontinuation of the power supply to the halogen heater 114 of the second external heating roller 104, and the variation in the surface temperature of the second external heating roller 104 according to the present exemplary embodiment.

The surface temperature of the second heating roller 104 decreases to the lower limit setting temperature at time t131. At this time, the halogen heater 114 is powered on. The power supplied to the halogen heater 114 is as small as 600 W. Accordingly, the surface temperature of the external heating roller 104 slowly reaches the upper limit setting temperature in a long time period from the time t131 to time t132. In this case, the area of the fixing roller 101 that contacts the halogen heater 114, whose temperature is on the rise, becomes larger. Therefore, the unevenness in the surface temperature of the fixing roller 101 can be reduced.

As compared with the comparative example 1, in the present exemplary embodiment, the normal rated power of the entire fixing device can be reduced by 400 W from 3,500 W to 3,100 W. Accordingly, the present exemplary embodiment can achieve low power while maintaining the toner fixing property of thick paper at an equal level.

As described above, in the present exemplary embodiment, the normal rated power of the halogen heater 113 of the first external heating roller 103 disposed upstream of the fixing roller 101 in the rotational direction of the fixing roller 101 is increased, while the normal rated power of the halogen heater 114 of the second external heating roller 104 disposed downstream of the fixing roller 101 in the rotational direction of the fixing roller 101 is decreased.

With the above-described configuration, the present exemplary embodiment can realize a fixing device capable of maintaining a high fixing property (keeping the lowest temperature), achieving low power, and reducing the unevenness in the temperature thereof.

Accordingly, by satisfying the condition "the normal rated power of a heat source of an external heating member disposed upstream of a fixing member in the rotational direction of the fixing member>the normal rated power of a heat source of an external heating member disposed downstream of the fixing member in the rotational direction of the fixing member", the present exemplary embodiment can implement a fixing device capable of maintaining a high fixing property, achieving low power, and reducing the unevenness in the temperature thereof.

In the present exemplary embodiment, the normal rated power of the heat source of the first external heating roller 103 disposed upstream of the fixing roller 101 in the rotational direction of the fixing roller 101 is set to be 20% or more greater than the heat source of the second external heating roller 104 disposed downstream of the fixing roller 101 in the rotational direction of the fixing roller 101. With the above-described configuration, the present exemplary embodiment can achieve low power and reduce the unevenness in the temperature of the fixing roller 101.

Accordingly, it is more useful if the condition "the normal rated power of a heat source of an external heating member disposed upstream of a fixing member in the rotational direction of the fixing member≧(the normal rated power of a heat source of an external heating member disposed downstream of the fixing member in the rotational direction of the fixing member×1.2)" is satisfied.

In the present exemplary embodiment, the target temperature of the temperature of the first external heating roller 103 and the second external heating roller 104 are set at the same temperature of 220° C. considering the limit of the heat resistance property of the fixing device members (the thermister, the PFA tube, and the like). In this regard, it is useful to set the target temperature of the external heating rollers at a high temperature almost to a limit of the heat resistance because the heating property of the fixing roller may degrade if the temperature of the external heating roller is low.

In the present exemplary embodiment, the fixing roller having the heat source inside thereof is used as the fixing member. However, the present exemplary embodiment is not limited to this embodiment. More specifically, the effect of the present invention can also be achieved when the fixing roller does not include a heat generation member and a fixing roller is heated only by the external heating roller.

Furthermore, the effect of the present invention can also be achieved when a different type of a fixing member such as a fixing belt is used as long as the fixing member is provided with an elastic layer.

In addition, in the present exemplary embodiment, the pressure roller including the heat source inside is used as the pressure member. However, the present exemplary embodiment is not limited to this embodiment. More specifically, the effect of the present invention can also be achieved even when the pressure roller does not include a heat generation member.

Furthermore, in the present exemplary embodiment, the pressure roller whose core is coated with the elastic layer is used as the pressure member. However, the present exemplary embodiment is not limited to this embodiment. More specifically, the effect of the present invention can also be achieved when a different type of a pressure member, such as a pressure belt or a pressure roller or a pressure belt including no elastic layer, is used.

Furthermore, in the present exemplary embodiment, the external heating roller is used as the external heating member. However, the present exemplary embodiment is not limited to this embodiment. More specifically, the effect of the present invention can be achieved as long as a plurality of external heating members is used. For example, the present invention can also be achieved when external heating members such as external heating belts or external heating films are used, or heat generation members different from halogen heaters, such as electromagnetic induction heating type heat generation members or plane heat generation members, are used.

Furthermore, in the present exemplary embodiment, one halogen heater is included in one external heating roller. However, the effect of the present invention can also be achieved when first and second external heating rollers (103 and 104) include a plurality of halogen heaters if the image heating apparatus is configured in a following manner. Namely, the sum of the normal rated power of the halogen heaters in the second external heating roller 104 is smaller than the sum of the normal rated power of the halogen heaters in the first external heating roller 103.

In the present exemplary embodiment, the power as high as the normal rated power of each halogen heater is supplied to the halogen heater. However, the effect of the present invention can also be achieved when the power lower than the normal rated power of each halogen heater is supplied to the halogen heater. In this case, the maximum value of the power to be supplied to the halogen heater 114 of the second external heating roller 104 is set smaller than the maximum value of the power to be supplied to the halogen heater 113 of the first external heating roller 103.

In addition, the effect of the present invention can also be achieved when the power lower than the normal rated power of each halogen heater is supplied to a plurality of halogen heaters of the first and the external heating rollers (103 and 104). More specifically, in this case, the maximum value of the sum of the power supplied to the halogen heater provided in the second external heating roller 104 is set smaller than the maximum value of the sum of the power supplied to the halogen heater provided in the first external heating roller 103.

Now, a second exemplary embodiment of the present invention will be described in detail below with reference to FIGS. 14 through 17, FIG. 19, and Table 1.

By a method according to the present exemplary embodiment, the temperature rise in a paper non-passage area can be efficiently reduced and decrease of the lowest temperature in the fixing member can be prevented. The temperature rise may occur when small size paper is fed through the fixing roller. The method is described with respect to the normal rated power of the heat generation member provided in the external heating member according to the first exemplary embodiment. Also in the present exemplary embodiment, the power equivalent to the normal rated power of each halogen heater is supplied to the heater.

When small size paper is fed through the fixing device, the temperature of a paper non-passage area may rise.

This temperature rise in the paper non-passage area may arise as follows. In a paper passage area of the fixing device, the recording material absorbs the heat of the fixing member or a pressure member. Then, the heat is supplied to the fixing member or the pressure member to raise the temperature thereof to a predetermined temperature in order to secure a sufficiently high fixing property. On the other hand, in the paper non-passage area, the heat of the fixing member or the pressure member is not lost while the heat is continuously supplied thereto. Thus, the temperature of the fixing member or the pressure member rises. If the temperature of the fixing device member exceeds the heat resistant temperature due to the rise of the temperature in the paper non-passage area, the elastic layer, the releasing layer, and the thermister, for example, may be damaged or broken due to thermal degradation.

In the present exemplary embodiment, in order to address the rise of the temperature in the paper non-passage area, a plurality of heat sources having different heat generation distribution in the longitudinal direction is provided to each member of the fixing device.

With this configuration, the present exemplary embodiment can reduce the amount of heat in the heat source disposed in the paper non-passage area, according to the size of a recording material or the temperature detected by a temperature detection unit disposed in the paper non-passage area of each fixing device member. With the above-described configuration, the present exemplary embodiment can suppress the rise of the temperature in the fixing device member in the paper non-passage area while maintaining the appropriate temperature of the fixing device member in the paper passage area.

A fixing device 200 according to the present exemplary embodiment will be described in detail below. Members and components of the fixing device 200 having the same configuration and the same effect as those of the fixing device 100 in the first exemplary embodiment are provided with the same reference numerals and symbols as those of the fixing device 100. Accordingly, the detailed description thereof will not be repeated here. The fixing device 200 is also installed in the image forming apparatus illustrated in FIG. 1.

Figure 14:
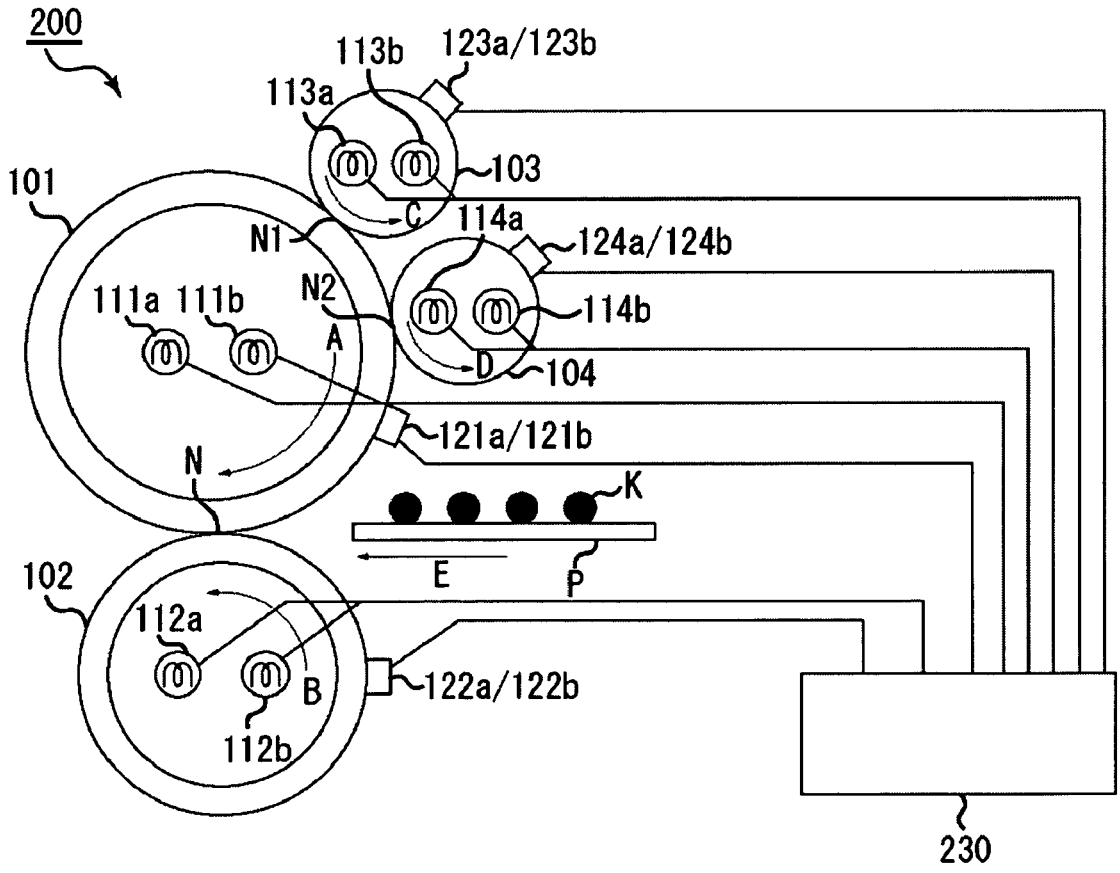
FIG. 14 is a cross section illustrating an example of an external heating type fixing device according to a second exemplary embodiment of the present invention.

The fixing device 200 illustrated in FIG. 14 has the configuration substantially the same as the fixing device 100 (FIG. 2) except that the fixing device 200 includes two halogen heaters as the heat source (the heat generation member) of each roller and that the fixing device 200 includes two thermisters in the longitudinal direction as the temperature detection unit of each roller. The center of the roller is used as a paper feeding reference position.

As illustrated in FIG. 14, the heat generation member of the fixing roller 101 includes a halogen heater 111*a* having the normal rated power of 600 W and a halogen heater 111*b* having the normal rated power of 600 W, for example. The total of the normal rated power of the halogen heater 111*a* and the halogen heater 111*b* is 1,200 W. However, the heat distributions of the halogen heaters 111*a* and 111*b* are different.

Figure 15:
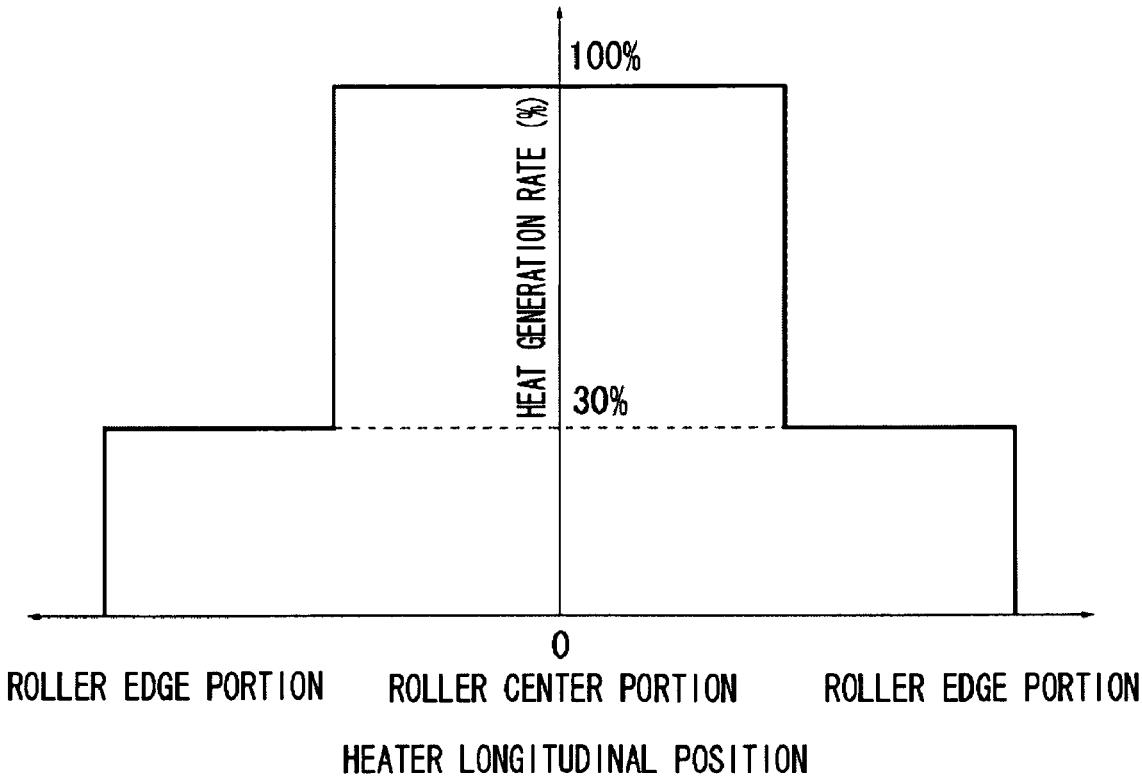
FIG. 15 illustrates an exemplary distribution of generated heat at a longitudinal position of a main heater according to the second exemplary embodiment of the present invention.

As illustrated in FIG. 15, the halogen heater 111*a* is adjusted so that the ratio of the amount of generated heat in the edge portion of the roller becomes 30% to the amount of generated heat in the center of the roller when the normal rated power is supplied. In other words, the amount of generated heat in the edge portion of the roller is smaller than the amount of generated heat in the center when the normal rated power is supplied to the halogen heater 111*a*. Hereinbelow, the halogen heater 111*a* is referred to as a "main heater 111*a*".

Figure 16:
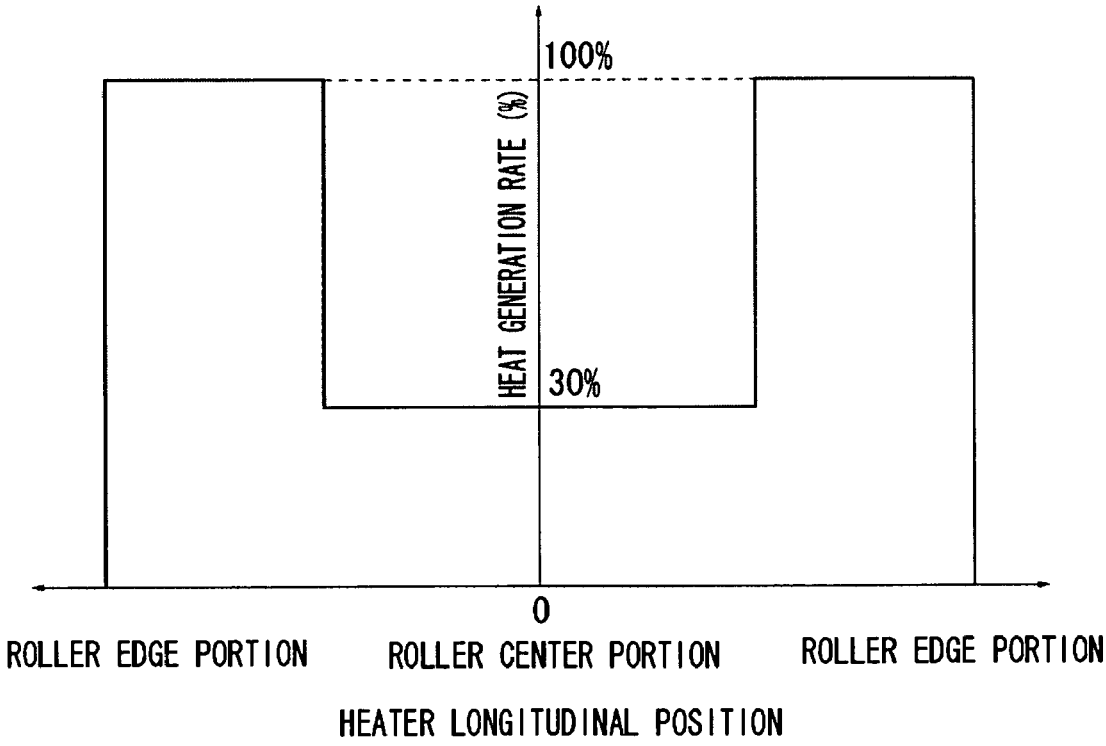
FIG. 16 illustrates an exemplary distribution of generated heat at a longitudinal position of a sub heater according to the second exemplary embodiment of the present invention.

As illustrated in FIG. 16, the halogen heater 111*b* is adjusted so that the ratio of the amount of generated heat in the center of the roller becomes 30% to the amount of generated heat in the edge portion of the roller when the normal rated power is supplied. In other words, the amount of generated heat in the center is smaller than the amount of generated heat in the edge portion when the normal rated power is supplied to the halogen heater 111*b*. Hereinbelow, the halogen heater 111*b* is referred to as a "sub heater 111*b*".

The surface temperature of the fixing roller 101 is detected by a thermister (temperature detection unit) 121*a*, which contacts the paper passage area of the fixing roller 101. According to the detected temperature, a heater control unit 230 powers on and off the main heater 111*a* and the sub heater 111*b* to adjust the temperature of the heaters to a predetermined target temperature of 200° C., for example.

The control is executed by the method similar to the control of the surface temperature of the fixing roller 101 as described in the first exemplary embodiment. More specifically, the upper limit setting temperature is set at a temperature 1° C. higher than the target temperature while the lower limit setting temperature is set at a temperature 1° C. lower than the target temperature.

Furthermore, the present exemplary embodiment monitors the surface temperature of the fixing roller 101 with a thermister 121*b*, which contacts the paper non-passage area of the fixing roller 101. The thermister 121*a* is a temperature control thermister for controlling the main heater 111*a* and the sub heater 111*b* to maintain the surface temperature of the fixing roller 101 in the paper passage area at a predetermined temperature. Hereinbelow, the thermister 121*a* is referred to as a "main thermister 121*a*". The thermister 121*b* monitors the surface temperature of the paper non-passage area of the fixing roller 101. Hereinbelow, the thermister 121*b* is referred to as a "sub thermister 121*b*".

As illustrated in FIG. 14, the heat generation member of the pressure roller 102 includes a halogen heater 112*a* having the normal rated power of 150 W and a halogen heater 112*b* having the normal rated power of 150 W, for example. The total of the normal rated power of the halogen heater 112*a* and the halogen heater 112*b* is 300 W. However, the heat distributions of the halogen heaters 112*a* and 112*b* are different.

As illustrated in FIG. 15, the halogen heater 112*a* is adjusted so that the ratio of the amount of generated heat in the edge portion of the roller becomes 30% to the amount of generated heat in the center of the roller (100%). In other words, the amount of generated heat in the edge portion of the roller is smaller than the amount of generated heat in the center of the roller. Hereinbelow, the halogen heater 112*a* is also referred to as a "main heater 112*a*".

As illustrated in FIG. 16, the halogen heater 112*b* is adjusted so that the ratio of the amount of generated heat in the center of the roller becomes 30% to the amount of generated heat in the edge portion of the roller (100%). In other words, the amount of generated heat in the edge portion of the roller is larger than the amount of generated heat in the center of the roller. Hereinbelow, the halogen heater 112*b* is also referred to as a "sub heater 112*b*".

The surface temperature of the pressure roller 102 is detected by a thermister 122*a* that contacts the paper passage area of the pressure roller 102. The heater control unit 230 powers on and off the main heater 112*a* and the sub heater 112*b* to adjust the surface temperature of the pressure roller 102 at a predetermined target temperature of 130° C., for example.

Figure 19:
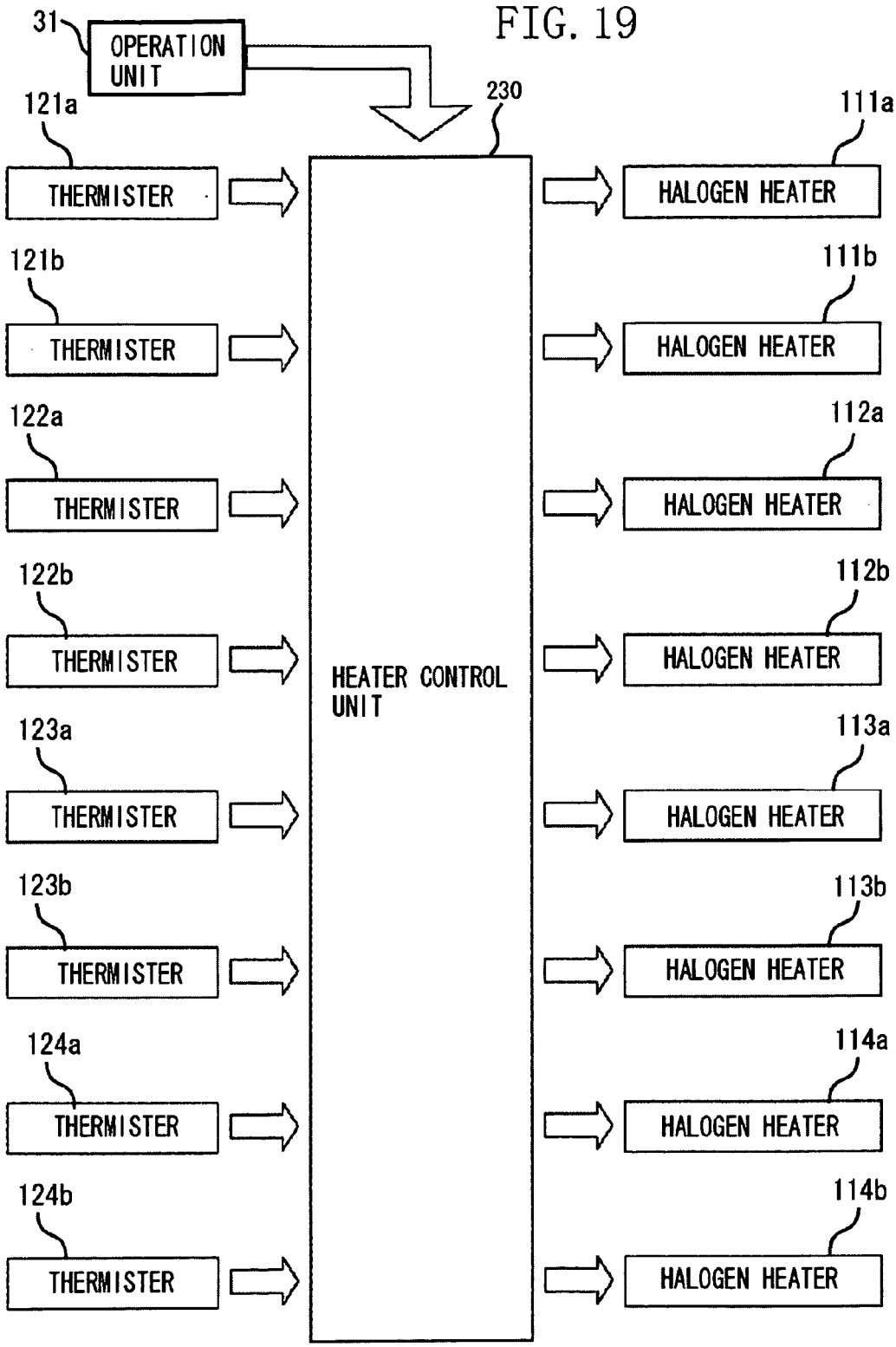
FIG. 19 illustrates an exemplary configuration of a control circuit according to the second exemplary embodiment of the present invention.

The control is executed by the method similar to the control of the surface temperature of the fixing roller 101 as described in the first exemplary embodiment. More specifically, the upper limit setting temperature is set at a temperature 1° C. higher than the target temperature while the lower limit setting temperature is set at a temperature 1° C. lower than the target temperature. In this regard, FIG. 19 illustrates an exemplary configuration of temperature control according to the present exemplary embodiment.

Furthermore, a thermister 122*b*, which contacts the paper non-passage area of the pressure roller 102, monitors the surface temperature of the paper non-passage area of the pressure roller 102.

Accordingly, the thermister 122*a* is a temperature control thermister for controlling the main heater 112*a* and the sub heater 112*b* to maintain the surface temperature of the paper passage area of the pressure roller 102 at a predetermined temperature. Hereinbelow, the thermister 122*a* is referred to as a "main thermister 122*a*". Furthermore, the thermister 122*b* monitors the surface temperature of the paper non-passage area of the pressure roller 102. Hereinbelow, the thermister 122*b* is referred to as a "sub thermister 122*b*".

As illustrated in FIG. 14, the heat source of the first external heating roller 103 includes a halogen heater 113*a* having the normal rated power of 500 W and a halogen heater 113*b* having the normal rated power of 500 W, for example. The total of the normal rated power of the halogen heaters 113*a* and 113*b* is 1,000 W. However, the heat distributions of the halogen heaters 113*a* and 113*b* are different.

As illustrated in FIG. 15, the halogen heater 113*a* is adjusted so that the ratio of the amount of generated heat in the edge portion of the roller becomes 30% to the amount of generated heat in the center of the roller (100%). In other words, the amount of generated heat in the edge portion of the roller is smaller than the amount of generated heat in the center of the roller. Hereinbelow, the halogen heater 113*a* is also referred to as a "main heater (first main heater) 113*a*".

As illustrated in FIG. 16, the halogen heater 113*b* is adjusted so that the ratio of the amount of generated heat in the center of the roller becomes 30% to the amount of generated heat in the edge portion of the roller (100%). In other words, the amount of generated heat in the edge portion of the roller is larger than the amount of generated heat in the center of the roller. Hereinbelow, the halogen heater 113*b* is also referred to as a "sub heater (first sub heater) 113*b*".

The surface temperature of the first external heating roller 103 is detected by a thermister 123*a* that contacts the paper passage area of the first external heating roller 103. The heater control unit 230 powers on and off the main heater 113*a* and the sub heater 113*b* to adjust the surface temperature of the first external heating roller 103 at a predetermined target temperature of 220° C., for example.

The control is executed by the method similar to the control of the surface temperature of the fixing roller 101 as described in the first exemplary embodiment. More specifically, the upper limit setting temperature is set at a temperature 1° C. higher than the target temperature while the lower limit setting temperature is set at a temperature 1° C. lower than the target temperature.

In addition, a thermister 123*b*, which contacts the paper non-passage area of the first external heating roller 103, monitors the surface temperature of the paper non-passage area of the first external heating roller 103.

The thermister 123*a* is a temperature control thermister for controlling the main heater 113*a* and the sub heater 113*b* to maintain the surface temperature of the paper passage area of the first external heating roller 103 at a predetermined temperature. Hereinbelow, the thermister 123*a* is referred to as a "main thermister 123*a*". Furthermore, the thermister 123*b* monitors the surface temperature of the paper non-passage area of the first external heating roller 103. Hereinbelow, the thermister 123*b* is referred to as a "sub thermister 123*b*".

The second external heating roller 104 has the configuration substantially the same as that of the first external heating roller 103.

As illustrated in FIG. 14, the heat generation member of the second external heating roller 104 includes a halogen heater 114*a* having the normal rated power of 300 W and a halogen heater 114*b* having the normal rated power of 300 W, for example. The total of the normal rated power of the halogen heaters 114*a* and 114*b* is 600 W. However, the heat distributions of the halogen heaters 114*a* and 114*b* are different.

As illustrated in FIG. 15, the halogen heater 114*a* is adjusted so that the ratio of the amount of generated heat in the edge portion of the roller becomes 30% to the amount of generated heat in the center of the roller (100%). In other words, the amount of generated heat in the edge portion of the roller is smaller than the amount of generated heat in the center of the roller. Hereinbelow, the halogen heater 114*a* is also referred to as a "main heater (second main heater) 114*a*".

As illustrated in FIG. 16, the halogen heater 114*b* is adjusted so that the ratio of the amount of generated heat in the center of the roller becomes 30% to the amount of generated heat in the edge portion of the roller (100%). In other words, the amount of generated heat in the edge portion of the roller is larger than the amount of generated heat in the center of the roller. Hereinbelow, the halogen heater 114*b* is also referred to as a "sub heater (second sub heater) 114*b*".

The surface temperature of the second external heating roller 104 is detected by a thermister 124*a* that contacts the paper passage area of the second external heating roller 104. The heater control unit 230 powers on and off the main heater 114*a* and the sub heater 114*b* to control (adjust) the surface temperature of the second external heating roller 104 at a predetermined target temperature of 220° C., for example.

In addition, a thermister 124*b*, which contacts the paper non-passage area of the second external heating roller 104, monitors the surface temperature of the paper non-passage area of the second external heating roller 104.

Accordingly, the thermister 124*a* is a temperature control thermister for controlling the main heater 114*a* and the sub heater 114*b* to maintain the surface temperature of the paper passage area of the second external heating roller 104 at a predetermined temperature. Hereinbelow, the thermister 124*a* is referred to as a "main thermister 124*a*". Furthermore, the thermister 124*b* is a thermister for monitoring the surface temperature of the paper non-passage area of the second external heating roller 104. Hereinbelow, the thermister 124*b* is referred to as a "sub thermister 124*b*".

The apparatus according to the present exemplary embodiment is designed such that in each of the above-described rollers, when two heaters, namely, each main heater (111*a*, 112*a*, 113*a*, or 114*a*) and each sub heater (111*b*, 112*b*, 113*b*, or 114*b*), are powered on at the same time, the amount of generated heat becomes substantially the same in the longitudinal direction.

An exemplary method for preventing the rise in the temperature of the paper non-passage area will be described in detail below. By the method for preventing the rise in the temperature of the paper non-passage area, the ratio of power supply to the sub heater (111*b*, 112*b*, 113*b*, or 114*b*) of each roller is reduced if the temperature of the paper non-passage area of each roller has risen due to the feeding of small size paper sheets. The sub heater power supply ratio is changed according to the temperature detected by the sub thermister (121*b*, 122*b*, 123*b*, or 124*b*) for the paper non-passage area of each roller or according to the size of the recording material.

As the method for changing the sub heater power supply ratio, time division control, for example, is used when a halogen heater is used. The condition for the time division control is determined according to the relationship between the sub heater power supply time ratio and the time division control illustrated in Table 1, for example.

TABLE 1

| Sub Heater Power Supply Time Ratio | Sub Heater Time Division Control |
|---|---|
| 0% | Totally Kept OFF |
| 20% | ON for 1 sec and OFF for 4 sec |
| 25% | ON for 1 sec and OFF for 3 sec |
| 33% | ON for 1 sec and OFF for 2 sec |
| 40% | ON for 2 sec and OFF for 3 sec |
| 50% | ON for 2 sec and OFF for 2 sec |
| 60% | ON for 3 sec and OFF for 2 sec |
| 66% | ON for 2 sec and OFF for 1 sec |
| 75% | ON for 3 sec and OFF for 1 sec |
| 80% | ON for 4 sec and OFF for 1 sec |
| 100% | Totally Kept ON |

A case where the sub heater power supply time ratio=50% will be described in detail below as an example.

When the temperature detected by each of the main thermisters (121*a*, 122*a*, 123*a*, and 124*a*) for controlling the temperature of each roller decreases to a temperature below the lower limit setting temperature, each main heater (111*a*, 112*a*, 113*a*, and 114*a*) is powered on. In addition, each sub heater (111*b*, 112*b*, 113*b*, and 114*b*) is also powered on. At this time, the main heater is totally kept powered ON (the power supply thereto is continued) while the sub heater is repeatedly powered on for two seconds and off for subsequent two seconds.

Thus, the amount of generated heat in the edge portion of the roller can be reduced by decreasing the power supply time ratio of the sub heater, whose amount of generated heat is large in the edge portion of the roller. Accordingly, the present exemplary embodiment can suppress or at least reduce the rise of the temperature in the paper non-passage area.

The temperature of the paper passage area in the roller center portion can be maintained at a predetermined temperature by continuing the power supply to the main heater. Thus, the appropriate fixing property can be secured. If the temperature of the main thermister has risen to a temperature higher than the setting temperature, both the main heater and the sub heater are powered off.

Accordingly, the sub heater power supply time ratio refers to the ratio of power supply to the sub heater, to power supply to the main heater when the power is supplied to the main heater. More specifically, the sub heater power supply time ratio refers to the ratio of the time of power supply to the sub heater, to the time of power supply to the main heater. Furthermore, the power supply time ratio can be arbitrarily designated according to a condition such as the grammage, the paper type, or the size of a recording material.

A method for preventing or reducing the excessive rise of the temperature in the paper non-passage area of the external heating member will be described in detail below. As small size paper sheets are serially fed through the fixing roller 101, the generated heat accumulates in the paper non-passage area of the fixing roller 101. Thus, the temperature of the paper non-passage area rises. Similarly, the heat accumulates in the portion (area) of the external heating roller corresponding to the paper non-passage area of the fixing roller 101. Thus, the temperature in the external heating roller corresponding to the paper non-passage area of the fixing roller 101 rises.

The heat of the external heating roller corresponding to the paper passage area of the fixing roller 101 is absorbed by the paper passage area of the fixing roller 101 since temperature of the paper passage area has decreased. Therefore, the heat is supplied to the area of the external heating roller to maintain the temperature thereof at a predetermined temperature. On the other hand, the temperature of the paper non-passage area in the fixing roller 101 rises to a high temperature since the heat is not absorbed (accumulates) in the area of the external heating roller corresponding to the paper non-passage area.

Accordingly, similar to the fixing member and the pressure member, which contact the recording material, the rise of temperature of the paper non-passage area may also occur in the external heating roller which does not contact the recording material although at a smaller level, compared with the fixing member or the pressure member.

It was found by the inventor of the present invention that it is useful to implement the following method in order to efficiently reduce the rise of the temperature of the paper non-passage area in the external heating roller and prevent the decrease of the lowest temperature when paper is fed. By this method, the power supply time ratio of the sub heater 113*b* of the first external heating roller 103 (hereinafter referred to as a "first power supply time ratio") is set smaller than the power supply time ratio of the sub heater 114*b* of the second external heating roller 104 (hereinafter referred to as a "second power supply time ratio"). More specifically, the first power supply time ratio=33% and the second power supply time ratio=75%.

Furthermore, the rise of the temperature in the paper non-passage area of the fixing roller can be reduced by preventing the rise of the temperature in the paper non-passage area of the external heating roller.

In the present exemplary embodiment, legal (LGL) paper (small size paper having the width of 215.9 mm and the length of 355.6 mm) sheets whose grammage is 300 g/m$^2$, which have been stacked in a portrait orientation, were serially fed at the printing speed of about 67 ppm through the fixing device 200 having the maximum paper feeding permissible width (in the direction of the rotational axis of the fixing roller 101) of 297 mm (the width equivalent to the longer side of an A4 size paper sheet). Here, concerning the capacity to reduce the rise of the temperature in the paper non-passage area, a difficult condition was placed by using the legal paper, which has a small width and a long length.

In the present exemplary embodiment, the power supply time ratio of the sub heater (111*b*, 112*b*, 113*b*, and 114*b*) is changed according to the paper size. With respect to the fixing roller 101 and the pressure roller 102, the power supply time ratio of the sub heater 111*b* and the sub heater 112*b*=50%. The temperature of the paper non-passage area is detected by the sub thermister (121*b*, 122*b*, 123*b*, and 124*b*).

In the present exemplary embodiment, the following upper limit temperature in the paper non-passage area, which is detected by the sub thermister, is used considering the thermal resistance of the fixing device member such as the elastic layer or the release layer. The surface temperature of the fixing roller=220° C. and the surface temperature of the first and the second external heating rollers=230° C.

(1) Setting of Power Supply Time Ratio in Comparative Example 4

In the comparative example 4, the following conditions were used. The first power supply time ratio of the sub heater 113*b* of the first external heating roller 103=75% and the second power supply time ratio of the sub heater 114*b* of the second external heating roller 104=75%. In this case, the temperature of the paper non-passage area of the fixing roller 101=224° C. and the temperature of the paper non-passage area of the first external heating roller 103=234° C. Accordingly, the temperature of the paper non-passage area exceeded the upper limit temperature. On the other hand, the temperature of the paper non-passage area of the second external heating roller 104=228° C., which was appropriately within the upper limit temperature. In this case, the lowest temperature of the fixing roller 101=T2. Accordingly, the recording material showed the appropriate toner fixing property.

Furthermore, at the lowest temperature T2, the temperature detected by the main thermister 123*a* of the first external heating roller 103=220° C. and the temperature detected by the main thermister 124*a* of the second external heating roller 104=220° C. Therefore, the setting temperature was achieved with respect to both rollers. Accordingly, it was necessary to further decrease the first power supply time ratio.

(2) Setting of Power Supply Time Ratio in Comparative Example 5

In the comparative example 5, the following conditions were used. The first power supply time ratio=50% and the second power supply time ratio=50%. In this case, the temperature of the paper non-passage area of the fixing roller 101=221° C. and the temperature of the paper non-passage area of the first external heating roller 103=231° C. Accordingly, the rise in the temperature of the paper non-passage area was improved and decreased in comparison with the comparative example 4 but the temperature of the paper non-passage area still exceeded the upper limit temperature.

Figure 17:
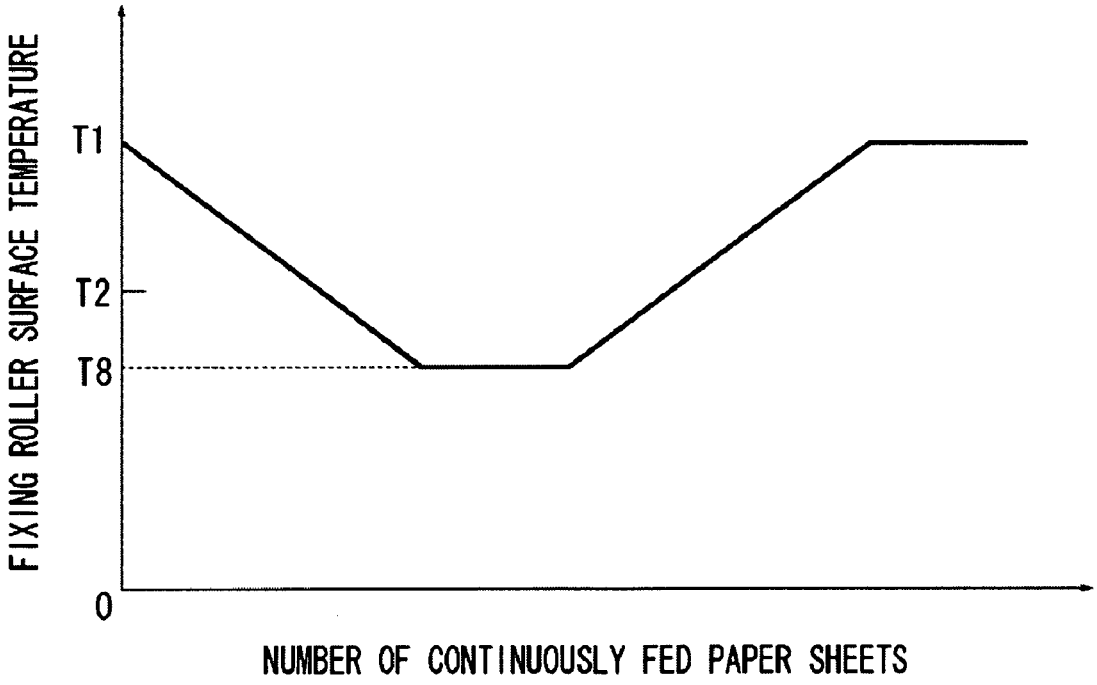
FIG. 17 illustrates the variation in the fixing roller surface temperature detected by a thermister when thick paper sheets are serially fed according to a comparative example 5 of the present invention.

On the other hand, the temperature of the paper non-passage area of the second external heating roller 104=225° C., which was appropriately within the upper limit temperature. In this case, however, as illustrated in FIG. 17, the lowest temperature of the fixing roller 101=T8, which is lower than T2. Accordingly, the toner fixing property of the recording material degraded and was not appropriate. In the present exemplary embodiment, T8=175° C.

When the lowest temperature of the fixing roller 101 is at T8, the temperature detected by the main thermister 123*a* of the first external heating roller 103=220° C. and the temperature detected by the main thermister 124*a* of the second external heating roller 104=210° C. More specifically, the lowest temperature of the fixing roller 101 decreased due to the degradation of the heating property of the external heating member, which occurred because the temperature of the second external heating roller 104 fell below the target temperature.

The degradation of the fixing property was caused by decrease of the lowest temperature since the power supplied to the second external heating roller 104 fell short because of the small power supply time ratio of the halogen heater 114*b*. Thus, the temperature of the second external heating roller 104 decreased.

Accordingly, it is necessary to increase the second power supply time ratio while reducing the first power supply time ratio.

(3) Setting of Power Supply Time Ratio According to Present Exemplary Embodiment The present exemplary embodiment was implemented under the following conditions. The first power supply time ratio=33% and the second power supply time ratio=75%. With respect to the temperature control unit (heater control unit) 230, the first power supply time ratio=33% and the second power supply time ratio=75% when paper having the length of 212.9 mm or less in the direction of the rotational axis of the fixing roller 101 is used. On the other hand, when paper having the length longer than 212.9 mm in the direction of the rotational axis of the fixing roller 101 is used, the first power supply time ratio=100% and the second power supply time ratio=100%.

Furthermore, the temperature control unit 230 changes the above-described power supply time ratio according to information about the length of the sheet (recording material) in the direction of the rotational axis of the fixing roller, which is entered by a user via an operation unit 31 (FIG. 1), or information about the length (width) of the sheet in the direction of the rotational axis of the fixing roller, which is detected by a recording material width detection device 26 (FIG. 1). A pair of light emission elements and a pair of light receiving elements installed across the conveyance path D can be used as the recording material width detection device 26.

In this case, the temperature of the paper non-passage area of the fixing roller 101=218° C., the temperature of the paper non-passage area of the first external heating roller 103=228° C., and the temperature of the paper non-passage area of the second external heating roller 104=228° C., which were appropriately within the upper limit temperature. In this case, the lowest temperature of the fixing roller 101=T2. Accordingly, the recording material showed the appropriate toner fixing property on.

Furthermore, when the lowest temperature was T2, the temperature detected by the main thermister 123*a* of the first external heating roller 103=220° C. and the temperature detected by the main thermister 124*a* of the second external heating roller 104=220° C. Therefore, the setting temperature was achieved with respect to both rollers. Accordingly, the rise of the temperature in the paper non-passage area was appropriately reduced while preventing the decrease of the lowest temperature under the condition "the first power supply time ratio<the second power supply time ratio".

With the above-described configuration, the present exemplary embodiment can efficiently reduce the rise of the temperature in the paper non-passage area while preventing the decrease of the lowest temperature of the fixing roller 101 under the condition "the first power supply time ratio<the second power supply time ratio" when small size paper is fed. Thus, the present exemplary embodiment can achieve the appropriate fixing property.

In the present exemplary embodiment, if "the normal rated power of the first external heating roller 103>the normal rated power of the second external heating roller 104", it was found that it is necessary to satisfy the condition "the first power supply time ratio<the second power supply time ratio" in order to reduce the rise of the temperature in the paper non-passage area that may occur when small size paper is fed.

This is because in order to reduce the rise of the temperature in the paper non-passage area, it is necessary to set the power supply time ratio of the sub heater of the external heating roller whose normal rated power is higher, to be smaller than the power supply time ratio of the sub heater of the external heating roller whose normal rated power is lower. On the other hand, in order to prevent the decrease of the lowest temperature, it is necessary to set the power supply time ratio of the sub heater of the external heating roller to be small within the range in which the temperature of the external heating roller does not fall below the setting temperature.

Furthermore, even if "the first power supply time ratio<the second power supply time ratio", it is also necessary, concerning the effective power (the total of the power supplied to the main heater and the sub heater), which is obtained by taking the power supply time ratio into consideration, to maintain the condition "the power supplied to the heat source of the first external heating roller>the power supplied to the heat source of the second external heating roller".

According to the present exemplary embodiment having the above-described configuration, the lowest temperature does not decrease to the low temperature in comparison with the first exemplary embodiment even if the power supply time ratio of the sub heater of the external heating roller is reduced. This effect may be achieved due to the following reasons. When small size paper having a small width is fed, the amount of heat absorbed by the sheet from the fixing roller 101 within a unit time is smaller than in the case of feeding a recording material having a large width. Furthermore, in this case, the amount of heat accumulated as the temperature rises in the paper non-passage area is transferred to the paper passage area via the core. Accordingly, the present exemplary embodiment can maintain the appropriate temperature of the external heating roller even if low power is supplied to the sub heater by reducing the sub heater power supply time ratio.

In the present exemplary embodiment, the sub heater power supply time ratio is changed according to the size of the recording material. However, it is more useful if the sub heater power supply time ratio is gradually changed according to a result of detecting the temperature of the paper non-passage area. In such a configuration, the rise in the temperature of the paper non-passage area can be more reduced and the decrease of the lowest temperature can be further prevented.

In this case, the following configuration can be employed. When legal paper satisfying the above-described conditions is fed, "the first power supply time ratio=100% and the second power supply time ratio=100%" as setting at the start of the operation. If either of the sub thermisters 123*b* and 124*b* has detected the temperature of 224° C., then the power supply time ratio is changed such that "the first power supply time ratio=33% and the second power supply time ratio=75%". Furthermore, if either of the sub thermisters 123*b* and 124*b* has detected the temperature of 226° C., then the power supply time ratio is changed such that "the first power supply time ratio=25% and the second power supply time ratio=60%".

In this case, since the sub heater power supply time ratio is reduced after the temperature of the paper non-passage area has risen to a sufficiently high temperature as described above, the amount of heat transferred from the paper non-passage area to the paper passage area is large. Accordingly, the decrease of the lowest temperature can be more effectively prevented. In addition, the sub heater power supply time ratio can be set small. Accordingly, the rise of the temperature in the paper non-passage area can be more effectively prevented.

Furthermore, the greater rise of the temperature in the paper non-passage area may occur in the fixing roller 101 than in the external heating rollers 103 and 104. Accordingly, it is also useful if the power supply time ratio of the sub heaters 113*b* and 114*b* of the external heating rollers 103 and 104 is changed according to the temperature of the paper non-passage area of the fixing roller 101, which is detected by the sub thermister 121*b*. With this configuration, the same effect of reducing the rise of the temperature in the paper non-passage area of the fixing roller 101 and the external heating rollers 103 and 104 as described above can also be achieved.

As described above in the first exemplary embodiment, it is useful to satisfy the condition "the normal rated power of a heat source of an external heating member disposed upstream of a fixing member in the rotational direction of the fixing member≧(the normal rated power of a heat source of an external heating member disposed downstream of the fixing member in the rotational direction of the fixing member×1.2)" to effectively save energy. In this case, under the above-described condition, it is also useful if the ratio of power supply is reflected on the sub heater power supply time ratio.

Accordingly, it is also useful if the condition "(the power supply time ratio of at least one heat source of the external heating member disposed upstream of the fixing member in the direction of rotation of the fixing member×1.2)≦(the power supply time ratio of at least one heat source of the external heating member disposed downstream of the fixing member in the direction of rotation of the fixing member)".

In the present exemplary embodiment, the term "power supply time ratio" is used to reflect usage of the halogen heater as heat source. However, if a plane heat generation member having a plane substrate coated with a resistive heat generation member applied thereon is used as the heat source, a different term, such as a "energization time ratio" or the like may be used.

Furthermore, the present exemplary embodiment employs the heater designed to generate the amount of heat substantially uniformly in the longitudinal direction when the main heater and the sub heater are powered on at the same time.

However, the present invention is not limited to this embodiment. The above-described effect of the present exemplary embodiment can be achieved if a main heater and a sub heater are used that generate the larger amount of heat in the edge portion of the roller than in the center portion thereof if the amount of radiation from the roller edge portion is large.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-139679 filed May 28, 2008, which is hereby incorporated by reference herein in its entirety.

What is claimed is:

1. An image heating apparatus comprising:

an image heating rotational member configured to heat an image on a recording material;

a pressure member configured to form a nip portion with the image heating rotational member and pinches the recording material heated by the image heating rotational member in the nip portion;

a first external heating member including a first heat generation member, the first external heating member configured to contact an outer surface of the image heating rotational member and heat an area of the image heating rotational member that has passed the nip portion; and a second external heating member including a second heat generation member, the second external heating member configured to contact an outer surface of the image heating rotational member at a position downstream of the first external heating member and upstream of the nip portion in a rotational direction of the image heating rotational member, wherein maximum power applied to the second heat generation member is smaller than maximum power applied to the first heat generation member.

2. The image heating apparatus according to claim 1, wherein the first heat generation member comprises:

a first main heater; and a first sub heater which generates a smaller amount of heat in a center portion of the image heating rotational member in a direction of a rotational axis thereof than the amount of heat generated by the first main heater in the center portion of the image heating rotational member in the direction of the rotational axis, and generates a larger amount of heat in an edge portion of the image heating rotational member in the direction of the rotational axis than the amount of heat generated by the first main heater in the edge portion of the image heating rotational member in the direction of the rotational axis, wherein the second heat generation member comprises:

a second main heater; and a second sub heater which generates a smaller amount of heat in the center portion of the image heating rotational member in the direction of the rotational axis thereof than the amount of heat generated by the second main heater in the center portion of the image heating rotational member in the direction of the rotational axis, and generates a larger amount of heat in the edge portion of the image heating rotational member in the direction of the rotational axis than the amount of heat generated by the second main heater in the edge portion of the image heating rotational member in the direction of the rotational axis, and wherein a maximum value of total power applied to the second main heater and the second sub heater is smaller than a maximum value of total power applied to the first main heater and the first sub heater.

3. The image heating apparatus according to claim 2, wherein in heating an image on a recording material which is shorter in the direction of the rotational axis than a predetermined length, a ratio of time for supplying power to the first sub heater, to time for supplying power to the first main heater is smaller than a ratio of time for supplying power to the second sub heater, to time for supplying power to the second main heater.

4. The image heating apparatus according to claim 1, further comprising a control unit configured to control power supplied to the first heat generation member so that a temperature of the first external heating member becomes a preset temperature, and to control power supplied to the second heat generation member so that a temperature of the second external heating member becomes the preset temperature.

5. The image heating apparatus according to claim 1, wherein the image heating rotational member includes a third heat generation member configured to heat the image heating rotational member.

* * * * *